US008500567B2

(12) United States Patent
Namala et al.

(10) Patent No.: US 8,500,567 B2
(45) Date of Patent: Aug. 6, 2013

(54) ELEVATOR MECHANISM AND RELATED COMPONENTS

(75) Inventors: Samuel R. Namala, Mechanicsville, VA (US); LeRoy T. Warren, Jr., Richmond, VA (US); Charles A. Lee, Williamsburg, VA (US); Mark D. Kilpatrick, Richmond, VA (US)

(73) Assignee: QUBICAAMF Worldwide LLC, Mechanicsville, VA (US)

( * ) Notice: Subject to any disclaimer, the term of this patent is extended or adjusted under 35 U.S.C. 154(b) by 383 days.

(21) Appl. No.: 12/776,179

(22) Filed: May 7, 2010

(65) Prior Publication Data

US 2010/0285895 A1 Nov. 11, 2010

Related U.S. Application Data

(60) Provisional application No. 61/213,128, filed on May 8, 2009.

(51) Int. Cl.
*A63D 5/08* (2006.01)

(52) U.S. Cl.
USPC ..... 473/73; 473/91; 473/97

(58) Field of Classification Search
USPC ..... 473/73, 91, 97; 198/618, 700, 793, 198/803.14, 804, 837, 838
See application file for complete search history.

(56) References Cited

U.S. PATENT DOCUMENTS

| | | | | | |
|---|---|---|---|---|---|
| 1,784,084 | A | * | 12/1930 | Williams | 473/97 |
| 2,060,491 | A | * | 11/1936 | Dunlop | 198/332 |
| 2,309,587 | A | * | 1/1943 | Hassler | 198/684 |
| 2,310,218 | A | | 2/1943 | Davis | |
| 2,319,925 | A | | 5/1943 | Flanagan | |
| 2,341,475 | A | * | 2/1944 | Parra et al. | 473/91 |
| 2,450,249 | A | | 9/1948 | Murphy | |
| 2,591,265 | A | * | 4/1952 | Johns et al. | 473/100 |
| 2,686,053 | A | | 8/1954 | Phillips | |
| 2,692,067 | A | * | 10/1954 | Hapman | 222/63 |
| 2,697,604 | A | * | 12/1954 | Blair | 473/97 |
| 2,765,897 | A | * | 10/1956 | Vamvakas et al. | 198/408 |
| 3,014,720 | A | | 12/1961 | Barrows | |
| 3,048,397 | A | * | 8/1962 | Holloway | 473/97 |
| 3,122,366 | A | * | 2/1964 | Albrecht | 473/97 |
| 3,142,486 | A | * | 7/1964 | Viescas | 473/97 |
| 3,179,410 | A | * | 4/1965 | Elliott | 473/97 |
| 3,407,919 | A | * | 10/1968 | Sandefur | 198/793 |
| 3,722,790 | A | * | 3/1973 | Natelson | 494/11 |
| 3,990,940 | A | * | 11/1976 | Lee et al. | 162/227 |
| 4,073,379 | A | * | 2/1978 | Schmid | 198/802 |
| 4,093,063 | A | * | 6/1978 | Calvert et al. | 198/419.3 |
| 4,109,446 | A | * | 8/1978 | Krohn et al. | 53/282 |
| 4,425,842 | A | * | 1/1984 | Winch et al. | 100/37 |

(Continued)

OTHER PUBLICATIONS

Standard Handbook of Chains: Chains for Power Transmissions and Material Handling, CRC Press, Boca Raton, FL, American Chain Association, 2006.*

(Continued)

*Primary Examiner* — William Pierce
(74) *Attorney, Agent, or Firm* — Andrew M. Calderon; Roberts Mlotkowski Safran & Cole

(57) ABSTRACT

An elevator assembly having a looped track assembly and a chain assembly having rollers which roll on the looped track assembly. The chain assembly includes spaced apart pin holders extending from the chain. A sprocket drive assembly engages the chain assembly.

42 Claims, 14 Drawing Sheets

(56) References Cited

U.S. PATENT DOCUMENTS

| | | | | |
|---|---|---|---|---|
| 4,638,906 | A * | 1/1987 | Winiasz | 198/803.9 |
| 4,949,962 | A * | 8/1990 | Gretzky | 473/97 |
| 6,027,411 | A * | 2/2000 | Huhne | 473/73 |
| 6,183,087 | B1 | 2/2001 | Kirkpatrick et al. | |
| 6,213,476 | B1 | 4/2001 | Chandler et al. | |
| 6,358,155 | B1 * | 3/2002 | Huhne | 473/73 |
| 6,855,081 | B2 | 2/2005 | Koschig | |
| 7,568,571 | B2 * | 8/2009 | Ogimura et al. | 198/332 |
| 8,051,971 | B2 * | 11/2011 | Marti Sala | 198/392 |

OTHER PUBLICATIONS

International Preliminary Report on Patentability for Appl. No. PCT/US2010/034095 mailed Nov. 17, 2011.

Written Opinion of the International Searching Authority for Appl. No. PCT/US2010/034095 mailed Jul. 7, 2010.

International Search Report and Written Opinion for corresponding International Application No. PCT/US2010/034095, Jun. 2010.

* cited by examiner

DETAIL A
TOOTH PROFILE
10 PLCS EQ. SPC'D

ELEVATOR MECHANISM AND RELATED COMPONENTS

CROSS REFERENCE TO RELATED APPLICATIONS

The present invention claims priority to U.S. provisional application Ser. No. 61/213,128, filed on May 8, 2009, the contents of which are incorporated by reference herein in their entirety.

BACKGROUND OF THE INVENTION

1. Field of the Invention

The present invention relates to a bowling apparatus and, more particularly, to an elevator mechanism and related components for use with a pinspotter apparatus.

2. Description of Background

A pinspotter is a device that automatically sets up and spots bowling pins on a bowling alley lane, amongst other features. More specifically, a pinspotter is a machine whose function is to automate the sport of bowling in the area of setting bowling pins on the bowling lane surface and returning bowling balls rolled down the lane by participants. An objective of the pinspotter is to provide pins to the pin deck rapidly so that a game of bowling can be played swiftly without undue delays. It is thus important that any such mechanism minimize the likelihood of jams, misplaced pins or other failure which would take an alley out of service and/or cause and unacceptable delay in a game of bowling.

To accomplish the functions of the pinspotter many mechanical and electrical components, including controllers, are required. For example, the mechanical components of a pinspotter include a cushion, which stops the ball and deflects it to the pit area to be returned to the bowler. Additional components include the sweep that is designed to remove fallen pins from the pin deck and adjacent gutters. A pin conveyor belt carries the fallen pins to the pin elevator, where they are carried up to the distributor assembly. The distributor assembly includes a conveyor having a cantilevered arm which swings transversely above a storage bin to which pins are delivered. The distributor is indexed to move successively to various positions by a central control system to appropriately distribute the pins from the pin elevator to the storage bin. An orientor pan moves with the distributor assembly. Once the pins are spotted, or re-spotted, the lane is ready for the game to continue or for a new game to begin.

The pin elevator, also known as a pinwheel lift assembly, is an integral unit (one piece) of the pinspotter. The pin elevator has a circular shape which includes indentations on an inner diameter surface for accommodating bowling pins. The circular shape allows bowling pins to be inserted within the indentations for lifting to the distributor assembly which, in turn, places the pins in a proper location in the pinspotter for subsequent standing (spotting). The diameter of the pinwheel lift assembly, though, is constrained by the width of the lane and, more specifically by the width of the pinspotter. That is, the diameter of the pinwheel lift assembly can be no larger than the width of a pinspotter, so that it can fit within the allotted space available. This constrains the number of pins that can be held on the pinwheel lift assembly, and brought to the distributor, as well as the total height the pins can be lifted to the distributor.

The pinwheel lift assembly is made from a durable steel material. The pinwheel lift assembly is large, and due to its many components has a tendency to wear down the pins. Also, using the pinwheel lift assembly requires other moving parts such as, for example, a moveable orientor pan which requires numerous adjustments to operate properly. The moveable orientor pan must also be coordinated with the rotation of the pinwheel lift assembly in order to ensure a smooth transition of pins from the pinwheel lift assembly to the distributor.

Also, due to the size and shape of the pinwheel lift assembly and the necessary framework required to support the pinwheel lift assembly, it is difficult to maintain and/or clean the machine and other related components. Additionally, the pinwheel lift assembly, due to its size constraints and construction, has a tendency to jam with pins. For example, the pinwheel lift assembly cannot provide a steep fall away angle with respect to the orientor pan. And, it is not possible to adjust the height of the pinwheel lift assembly to provide a steep fall away angle because it is not possible to increase the diameter of the pinwheel lift assembly due to the constrains imposed by the width of the pinspotter and bowling lane, itself. In turn, the distributor also cannot be positioned at a steep angle, with respect to the pin storage bin, thus resulting in a very shallow slope which affects the travel of the pins.

Moreover, the pinwheel lift assembly and many of its components are not interchangeable with one another amongst different pinwheel lift assemblies. For example, a pinwheel lift assembly and many of its components designed for an even numbered lane cannot be used for an odd numbered lane. More specifically, a pinwheel lift assembly designed to rotate counterclockwise would have indentations oriented in a certain position, whereas, a pinwheel lift assembly designed to rotate clockwise would require the indentations to be in the opposite orientation. Accordingly, the same pinwheel lift assembly cannot be used for different lanes. Likewise, a motor designed to rotate a pinwheel lift assembly in the counterclockwise direction cannot be used in a pinwheel lift assembly designed to rotate clockwise, as the entire belt and pulley assembly as well as the mounting assembly would require extensive retrofitting. This, of course, is disadvantageous in that if one machine requires repair, spare parts from other machines may not be used for such repairs.

Accordingly, there exists a need in the art to overcome the deficiencies and limitations described hereinabove.

BRIEF DESCRIPTION OF THE DRAWINGS

The present invention is described in the detailed description which follows, in reference to the noted plurality of drawings by way of non-limiting examples of exemplary embodiments of the present invention, in which like reference numerals represent similar parts throughout the several views of the drawings, and wherein.

SUMMARY

Figure 1:
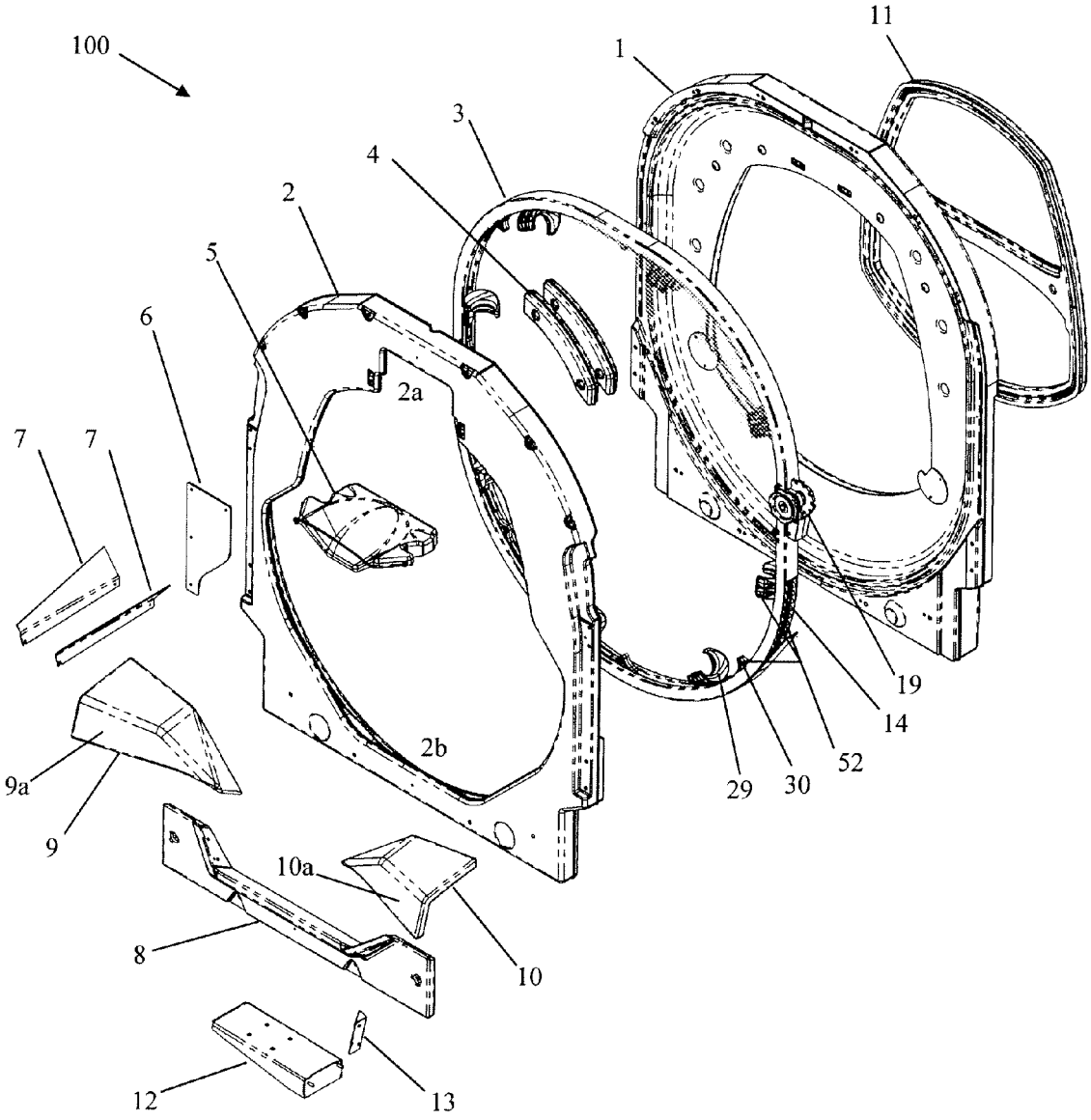
FIG. 1 shows an exploded view of components of the elevator assembly in accordance with embodiments of the invention.

In an aspect of the invention, an elevator assembly comprises a looped track assembly and a chain assembly having rollers which roll on the looped track assembly. The chain assembly comprises spaced apart pin holders extending from the chain. A sprocket drive assembly engages the chain assembly.

In an aspect of the invention, a pin holder comprises a tab portion and a body portion having a "C" shaped geometry. The body portion extends from the tab portion, the body portion comprises: slope surfaces extending to a central ridge which is structured to prevent a pin that has a diameter larger than a circumference of the central ridge from sliding completely therethrough and will hold the pin at a predetermined distance from a central portion, regardless of the orientation of the pin; and an opening structured to pick up and accommodate pins entering from either a first orientation which is head first or a second orientation which is bottom first.

In an aspect of the invention, a sprocket drive assembly, comprises a sprocket; a driving sheave; a driven sheave driven by the driving sheave and coupled to the sprocket by a shaft; an adjustable idler pulley; and a belt wrapped about the driving sheave and adjustable idler pulley and back-wrapped around the driven sheave by approximately 90°, which acts as a clutch mechanism. The adjustable idler pulley is structured to adjust a tension of the belt about the driven sheave.

In an aspect of the invention, a sprocket having a plurality of teeth, the plurality of teeth having a tooth profile comprises: a first radius of about 0.2, which has an arc length of 69° as measured from a horizontal centerline CL to a point "A" on a tooth; immediately adjacent and transitioning from the first radius is a second radius of about 0.50 to a point "B" on a tooth; immediately adjacent and transitioning from the second radius is a third radius of about 0.87 which has an arc length of 14.4°, as measured from the point "B" to point "C" on a tooth; and immediately adjacent and transitioning from the third radius is a fourth radius of about 0.09, which transitions into a flat portion FL of the tooth.

In an aspect of the invention, an elevator assembly comprises: a looped track assembly; a chain assembly having rollers which roll on the looped track assembly, the chain assembly comprises spaced apart pin holders extending from the chain; and a sprocket drive assembly which engages the chain assembly. The pin holders each include: a tab portion; and a body portion having a "C" shaped geometry. The body portion extends from the tab portion. The body portion comprises: sloped surfaces extending to a central ridge which is structured to prevent a pin that has a diameter larger than a circumference of the central ridge from sliding completely therethrough and will hold the pin at a predetermined distance from a central portion, regardless of the orientation of the pin; and an opening structured to pick up and accommodate pins entering from either a first orientation which is head first or a second orientation which is bottom first. The sprocket drive assembly, comprises: a sprocket; a driving sheave; a driven sheave driven by the driving sheave and coupled to the sprocket by a shaft; an adjustable idler pulley; and a belt wrapped about the driving sheave and adjustable idler pulley and back-wrapped around the driven sheave by approximately 90°, which acts as a clutch mechanism, wherein the adjustable idler pulley is structured to adjust a tension of the belt about the driven sheave. The sprocket has a plurality of teeth, the plurality of teeth having a tooth profile comprises: a first radius of about 0.2, which has an arc length of 69° as measured from a horizontal centerline CL to a point "A" on the tooth; immediately adjacent and transitioning from the first radius is a second radius of about 0.50 to a point "B"; immediately adjacent and transition from the second radius is a third radius of about 0.87 having an arc length of about 14.4°, as measured from point "B" to point "C"; and immediately adjacent and transitioning from the third radius is a fourth radius of about 0.094, which transitions into a flat portion FL of the tooth.

DESCRIPTION OF INVENTION

The present invention relates to a bowling apparatus and, more particularly, to an elevator mechanism and related components for use with a pinspotter apparatus. In particular, the present invention is related to an elevator mechanism which lifts bowling pins from a pit and places them onto a distributor mechanism (assembly) which, in turn, delivers the bowling pins to an ordered storage bin. From this storage bin, the bowling pins are ready for use by the pinspotter to be replaced on the lane surface. In embodiments, the elevator mechanism is an oval shape, which is more compact and, in embodiments, can be taller, than conventional elevator mechanism systems. This shape is possible due to the use of a unique chain driven system that, when powered, will elevate the bowling pins from a pit conveyor belt to the distributor on a pinspotting machine.

Advantageously, the present invention provides many advantages compared to a conventional elevator mechanism and related components. For example, the elevator mechanism can be made from thermoplastic materials, which reduces wear on the pins, and overall noise levels of the machine during use. The oval shape of the present invention allows the elevator mechanism to be taller than the conventional pin wheel elevator so that the o-pan has a steeper fall away angle (e.g., approximately 22° off horizontal) than an existing o-pan. This ensures that the pins will exit from the elevator mechanism properly and not become jammed.

A further advantage of the present invention is that the components of the elevator mechanism can be interchangeable amongst machines, thereby reducing the need for spare parts (or waiting for spare parts when none are readily available from the supplier and/or manufacturer), and ensuring less time needed for repairs. Accordingly, the components of the elevator mechanism can be fitted to any machine, regardless of whether it is rotating counterclockwise or clockwise. The components also allow for easy assembly and disassembly, thereby reducing overall "down-time". In addition, the components of the elevator mechanism, e.g., stationary orientor pan and/or other components such as flight cups, flight tabs, and/or carrier rails, will minimize pin jams. Other components such as the uniquely designed plow will also minimize damage to the pins. Moreover, many safety features are built into the system such as a clutch mechanism for rotating the chain driven system, as well as break-away parts that will ensure pins will not jam the system, as well as allowing the entire machine to be used for any lane, e.g., odd or even numbered lane.

FIG. 1 shows an exploded view of components of the elevator assembly in accordance with embodiments of the invention. More specifically, the elevator assembly 100 includes a front panel 2 and a rear panel 1 that can be coupled together by fastening mechanisms known to those of skill in the art. In embodiments, it is advantageous to have fastening mechanisms that can allow for disassembly of the panels 1, 2, for ease of repair or replacement of the components. In embodiments, the front panel 2 includes an opening 2*a*. In embodiments, the opening 2*a* is smaller than a length of a bowling pin but larger than the largest circumferential portion of the bowling pin. As an example, for regulation bowling pins, the opening 2*a* would be smaller than about 15 inches, but large enough to allow the bowling pin to exit therethrough, e.g., larger than about 5 inches. In embodiments, the opening is about 10 inches to 13 inches; although other dimensions are contemplated by the invention. More preferably, the opening is about 11.5 to about 12.5 inches wide.

The front panel 2 can also include a lower opening 2*b*, which has a flat section and two, opposing 45 degree angled walls. This configuration opens the front panel 2 to allow pins easy access to a chain track assembly 3 and related lift components. Of course, it should be appreciated that other dimensions are also contemplated by the present invention.

The front panel 2 and the rear panel 1 may form the frame of the elevator assembly 100. In embodiments, the front panel 2 and the rear panel 1 may be formed from a thermoplastic material, by a molding process. This will reduce overall weight and noise levels of the elevator assembly 100. In further embodiments, the front panel 2 and the rear panel 1 can be made from other plastics or other materials such as, for example, sheet metal, fiberglass or other durable type materials known to those of skill in the art. In embodiments, the panels 1, 2 can also be molded to form a chain track, as discussed in further detail below. In such embodiments, a separate chain track assembly would not be required.

Still referring to FIG. 1, the chain track assembly 3 is positioned between the panels 1, 2. The chain track assembly 3, as discussed in more detail below, can be composed of a rail system having at least two parts. The layered construction makes it easy to replace the chain track assembly 3 which is encapsulated between the two panels, e.g., two highly durable and impact resistant panels. In embodiments, the chain track assembly 3 can be in a loop such as, for example, an oval shape which has a width approximately equal to a width of a pinspotter assembly. The height of the chain track assembly, however, can be taller than conventional systems. The chain track assembly 3 can be formed from thermoplastic material, by a molding process, which will reduce overall weight and noise levels of the chain track assembly 3. It should be understood, though, that other materials are also contemplated by the present invention. For example, the chain track assembly 3 can be made from plastics or other materials such as, for example, sheet metal, or other durable materials. The chain track assembly 3 is also designed to accommodate a chain assembly 52. The chain assembly 52 may include, for example, flight cups 29 and flight tabs 30 coupled to a chain 14, as well as a sprocket drive assembly 19. In embodiments, the chain 14 can be a steel construction with plastic rollers as discussed in more detail below.

FIG. 1 further shows carrier rails 4 which are designed to be fitted between the panels 1, 2 and more specifically on an outside portion of the chain track assembly 3. The carrier rails 4 have a curvature that matches or substantially matches a curvature of the chain track assembly 3. By the placement and curvature of the carrier rails, bowling pins can be lifted by the chain assembly 52 from a vertical orientation to a horizontal orientation, prior to being discharged into a distributor system.

As discussed in more detail below, in embodiments, the carrier rails 4 can be spring loaded between the panels 1, 2. The spring loading allows for easy removal of the carrier rails 4, as well as ensures that bowling pins will not jam the system. For example, with regard to this latter feature, the spring loading will be of such a force that if two pins attempt to pass by the carrier rails 4, e.g., at a single time, the carrier rails 4 will simply disengage from the panels 1, 2 and allow the pins to fall to the pin conveyor belt. As with many components of the present invention, the carrier rails 4 can be formed from thermoplastic material, by a molding process, which will reduce overall weight and noise levels. It should be understood, though, that other materials are also contemplated by the present invention. For example, the carrier rails 4 can be made from plastics or other materials such as, for example, sheet metal, fiberglass or other durable materials.

The elevator assembly 100 also includes a stationary orientor pan 5 which is mounted to the front panel 2, aligned with the opening 2*a*. Also, the orientor pan 5 is stationary which eliminates the need to synchronize any movement with the distributor. Distributor guide plates 7 are mounted to a distributor. In embodiments, the distributor guide plates 7 are mounted in a funnel shape, to funnel the pins from the stationary orientor pin 5 to a distributor. A pin deflector plate 6 can be also be mounted to the front panel 2. This will ensure that the bowing pin does not fall out of the elevator assembly 100 after reaching this position.

Plows, e.g., center plow 8, right hand 9 and left hand 10 plow, are mounted to a lower end of a front face of the front panel 2. The plows, 8, 9 and 10 are designed to absorb the impact from the bowling pins and direct the bowling pins into the elevator assembly 100. The center plow 8 is designed to bridge a gap between the conveyor (in the pit) and the chain track assembly 3. The plows 9 and 10, on the other hand, each have a face 9*a* and 10*a*, respectively that has a minimal slope to ensure that the bowling pins, upon impacting the plows 9 and 10, will not fly into an upper portion of the elevator assembly 100. For example, the slope can be at an angle of about 20 degrees respective to an XY Plane and 75 degrees respective to an XZ plane. This feature will prevent jams and damage to the bowling pins. As should be understood by those of skill in the art, the above components can be manufactured from plastic such as, for example, thermoplastic materials. The plows are discussed in more detail with regard to FIG. 10.

Figure 2A:
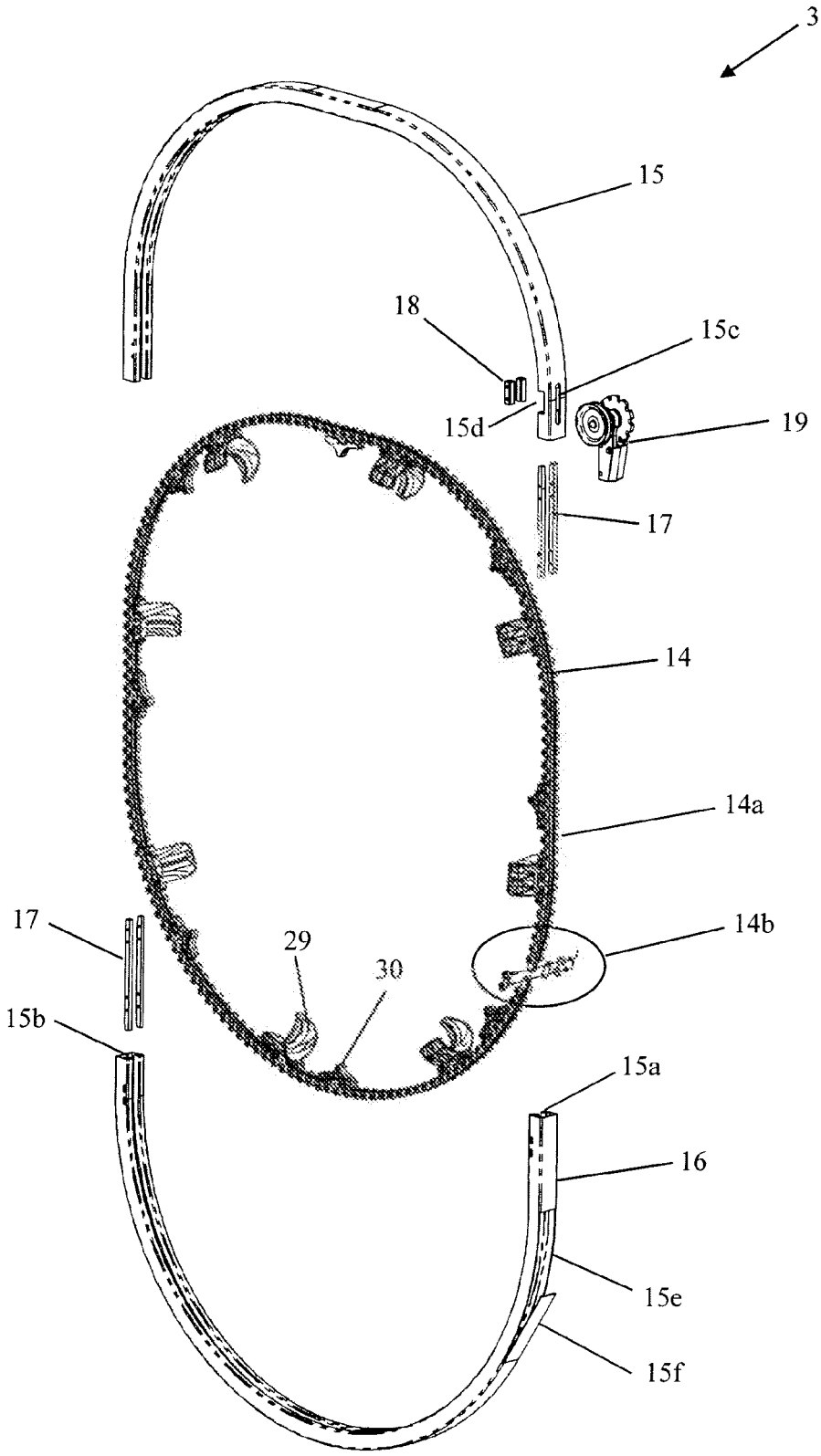
FIG. 2A shows an exploded view of chain track components of the elevator assembly in accordance with embodiments of the invention.

FIG. 2A shows an exploded view of the chain track assembly 3. As shown in FIG. 2A, the chain track assembly 3 includes a chain 14 with attachment links and outboard rollers 14*a*. The rollers 14*a* are preferably placed two at each link of the chain 14. The rollers 14*a* are preferably made from a durable plastic material and are designed to ride (slide) within the track assembly 3. The track assembly 3 can be an oval-like or circular shape or other shape, preferably with smooth curves. Due to the different track configurations, it is possible to increase the amount of pins that are held on the chain (and hence the pin carrier "flight cups"). This, in effect, can increase the pin carrying capabilities of the chain track assembly 3, and allow the pin delivery height to be changed in the future to accommodate design changes to other components of the pinspotter.

The chain track assembly 3 also includes two parts, an upper track 15 and a lower track 16. The lower track 16 preferably is formed in a constant radius to prevent the "pinching" of pins that occurs if any portion of the lower track should be straight. This "pinching" may cause jamming of the chain track assembly 3. The upper track 15 may include straight portions, e.g., such as at a top of the track or sides thereof. The straight portion can be about 10 inches in length, in embodiments. More specifically, the upper portion of the upper track 15 is formed with a straight section at the pin exit area to allow more time for pins to fall away from the chain 14 (e.g., flight cup 29) and onto the orientor pan 5.

The upper track 15 and the lower track 16 are joined together by joiners 17 that fit within corresponding formed sections 15*a* of the upper track 15 and the lower track 16. In embodiments, the joiners 17 can be steel or other durable material that can couple the upper track 15 to the lower track 16. In embodiments, the joiners 17 can also be fastened to the upper track 15 and the lower track 16 using fasteners such as, for example, screws. The formed sections 15*a* can be, for example, hollowed sections that correspond in cross section to the joiners 17. Advantageously, the formed sections 15*a* can also form a partially enclosed space for accommodating the chain 14 with attachment links and outboard rollers 14*a*. In embodiments, the outboard rollers 14*a* can glide (roll) between the formed sections 15*a* and an inner (back) surface 15*b* of the upper track 15 and lower track 16. The formed sections 15*a* also are spaced apart to accommodate components (e.g., flight cups 25 and flight tabs 30) attached to the chain 14 and protruding toward the inner part of the chain track assembly 3.

Below the drive, a portion 15*e* of the back wall 15*b* of the lower track 16 is removed to prevent the slack side of the chain 14 from bunching or binding in the chain track assembly 3. The cutout 15*e* begins at a point of tangency just below the drive where the curvature of the lower track begins, although other beginning points of the cutout are contemplated by the present invention. Below the point where the cutout begins, a section of the back wall 15*a* is seated in slots in the front and rear panels creating a ramp 15*f* that guides the slack portion of the chain 14 back into the chain track assembly 3. The ramp 14 can be about 9 inches long; although other lengths are also contemplated by the invention. The chain 14 can be inserted into the track by removing the connecting link 14*b* and feeding the chain through the upper and lower tracks 15 and 16. The two tracks 15 and 16 are assembled using the track joiners 17 and the connecting link 14*b* is reinstalled at the back cutout 15*e*. The chain is then tensioned by pulling track 16 away from track 15. Slots in track 16 allow the movement and fastening of track 16 to the joiners once proper chain tension has been established.

Figure 3:
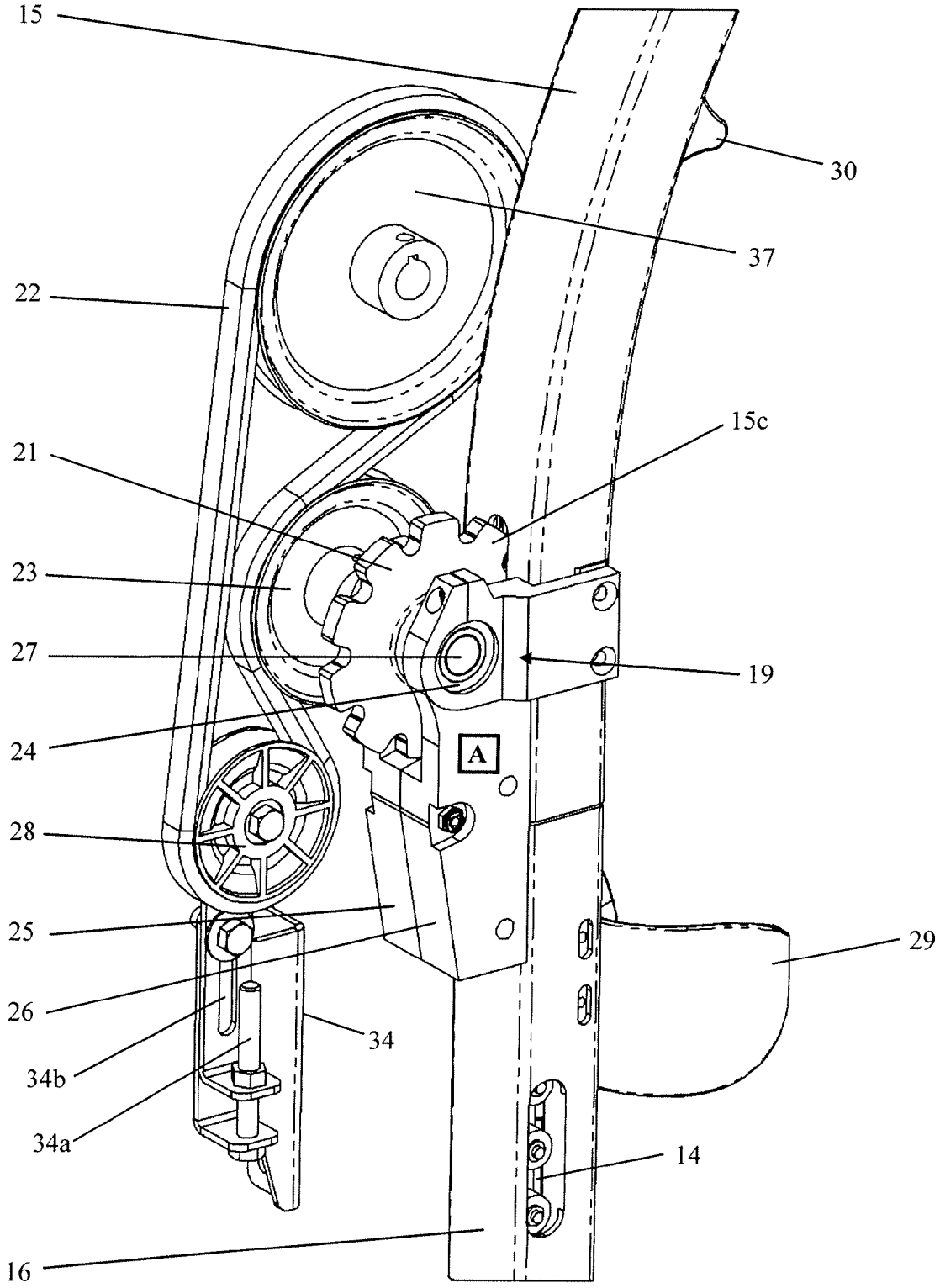
FIG. 3 shows the drive components, including a chain drive, track and related components in accordance with embodiments of the invention.

A slot 15*c* in the back of the upper track 15 exposes the chain 14 for engagement with a sprocket drive assembly 19 (see, e.g., FIG. 3). More specifically, the chain 14 is driven from the outside of the chain track assembly 3 linearly-like a rack and pinion gear system (which includes the sprocket drive assembly 19), as described in more detail below.

One or more wear sleeves 18 (which may be made from urethane or other durable material that can withstand impact and abrasion caused by the chain 14) is fitted into a notch 15*d* on a front (inner) side of the upper track 15. The wear sleeves 18 are aligned with the sprocket drive assembly 19. The wear sleeves 18 have a same cross section as corresponding portion of the tracks 15 and 16, and are retained by the joiners 17. The wear sleeves 18 are positioned at a location of high wear from the chain 14 and are preferably of a material that can withstand high impact and wear caused by the movement of the chain, opposite the sprocket drive assembly 19. The use of the wear sleeves 18 avoids the need to replace the entire upper track 15 which may be the result of wear caused by the chain 14. The wear sleeves 18 can be easily replaced by pulling the tracks 15 and 16 apart and removing one set (pair) of joiners 17 (as well as removing the sprocket assembly therefrom).

Figure 2B:
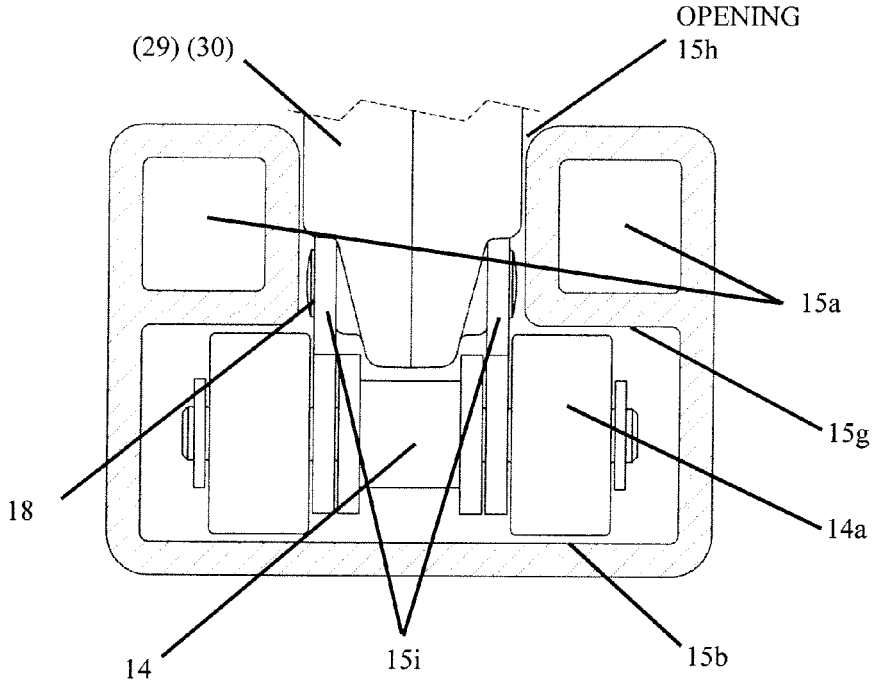
FIG. 2B shows a cross-section view of a roller chain in a chain track of the elevator assembly in accordance with embodiments of the invention.

FIG. 2B shows a cross-section of the chain track assembly 3. The chain track assembly 3 includes formed sections 15*a* (e.g., hollow sections or cavities) which accommodate the joiners 17. The wear sleeves 18 would also include the hollow section, much like the chain track assembly 3. In embodiments, the rollers 14*a* of the chain 14 will ride on contact surfaces. These contact surfaces may include, for example, the inner wall 15*b* of the chain track assembly 3 and a wall 15*g* of the formed sections 15*a*. More specifically, the rollers 14*a* are fully encapsulated within the chain track assembly 3.

The flight cups 29 and flight tabs 30 extend through a slit or opening 15*h* formed between the formed sections 15*a*. The flight cups 29 and flight tabs 30 are attached to the chain 14 by chain tabs 15*i*, which extend beyond (above) the rollers 14*a*. The chain tabs 15*i* are specialized links in the chain 14 incorporated for the purpose of attaching the flight cups 29 and flight tabs 30. The chain tabs 15*i* can be coupled to the flight cups 29 and flight tabs 30 by a press-fit dowel pin 18.

Figure 2C:
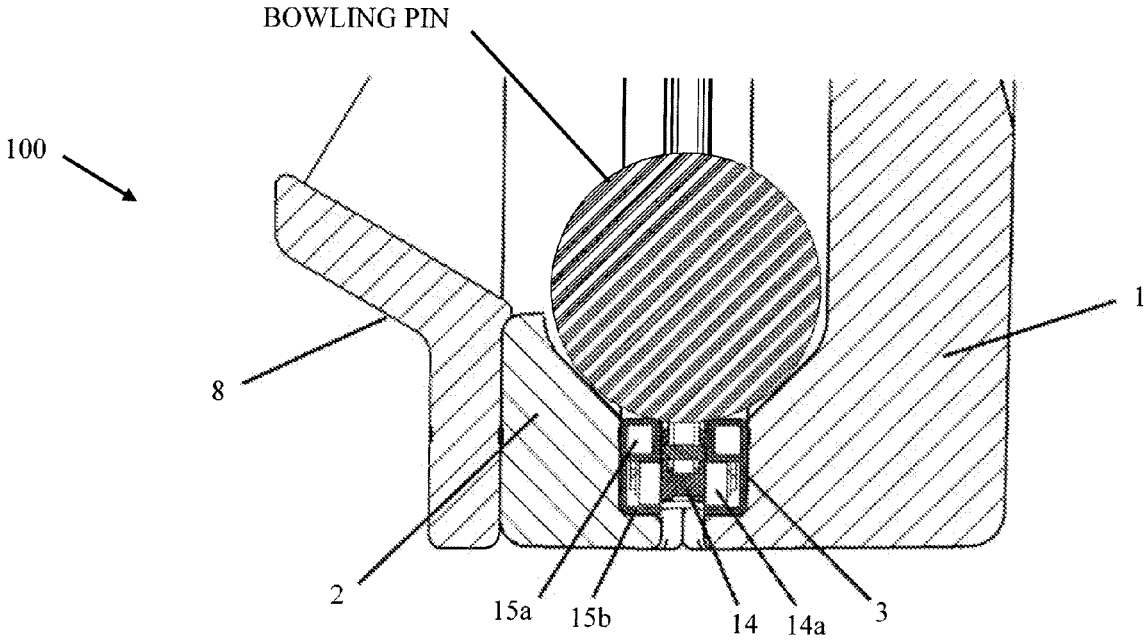
FIG. 2C shows a cross-section view of a pin trough created by assembling front and rear panels of the elevator assembly in accordance with embodiments of the invention.

FIG. 2C shows a cross-section view of the pin trough created by assembly of the front and rear panels of the elevator assembly 100 in accordance with embodiments of the invention. In particular, this view shows the front panel 2 connected to the rear panel 1, with the chain track assembly 3 therein. In embodiments, the chain track assembly 3 can be simply clipped into place or held in place by the front panel 2 and the rear panel 1, without the need for any fastening devices. The chain track assembly 3 would, in essence, be held by friction. For example, the front panel 2 and the rear panel 1 can have contours that define a cavity or area for the chain track assembly 3 such that no fasteners would be required to hold the chain track assembly in place. This cross-sectional view also shows the rollers 14*a* riding within the space (e.g., track) provided by the formed sections 15*a* and surface 15*b*. The chain 14 is shown to be fitted within this area, with the flight cups 29 and flight tabs 30 extending inwards, with respect to the elevator assembly 100. In embodiments, the chain track assembly can be formed from the front and rear panels, thus eliminating the need for a separate component.

FIG. 3 shows the drive components, including a chain drive, track and related components in accordance with embodiments of the invention. More specifically, the sprocket drive assembly 19 includes a uniquely designed sprocket 21 (as described in further detail with reference to FIGS. 13A-13C) coupled to a drive shaft 27 and a driven sheave 23. The drive shaft 27 couples the sheave 23 and the sprocket 21 and thus causes the sheave 23 and sprocket 21 to rotate in unison using radial bearings 24. Two housing halves 25, 26 attach to the joiners (not shown) through the wear sleeves 18 to support the sprocket drive assembly 19.

The drive system also includes a hex cross-section belt 22 which allows a conventional backend gearbox and driving sheave 37 to rotate the sprocket 21 which, in turn, drives the chain 14 (from the outside) in the proper direction of travel at the correct speed. The limited wrap about the driven sheave 23 allows the belt to slip if the chain or any component associated should become overloaded by external forces. Accordingly, this acts as a clutch mechanism which protects the components of the system and increases the operational safety of the pinspotter. In this configuration, about 40 lbs. of force is applied to the sprocket 21; however, it should be understood that other forces can also be applied depending on the amount of wrap around on the pulley 28 and the tension of the belt 22.

The positioning of a tensioned idler pulley 28 forces the hex shaped v-belt to wrap approximately 90 degrees around the driven sheave 23 mounted to the chain sprocket shaft 27. The pulley 28 can also be moved to adjust the tension on the belt 22 by use of the bracket mechanism 34. In embodiments, the bracket 34 includes a nut and bolt system 34*a* which can be tightened or loosened to move the pulley 28. Alternatively or in combination, a bolt and slot mechanism 34*b* is provided to move the pulley 28 and hence adjust the tension on the belt 22.

In embodiments, the drive system can also include an alarm signal "A". The alarm signal "A" can sound or cause a shutdown or power off condition to the elevator assembly or to the entire pinspotter machine when the belt begins to slip. This can be accomplished by monitoring, for example, the rotational speed of the drive sheave 37 and/or the driven sheave 23 and/or the pulley 28 and/or the chain 14.

In embodiments, the two housing halves 25, 26 couple/attach to the joiners (not shown) through the wear sleeves 18 by screws, bolts, or other fastening devices. This supports the entire sprocket assembly, joiners and wear sleeves to the track assembly. The two housing halves 25, 26 are preferably made from aluminum, but can be other materials such as a durable plastic material. In embodiments, the sprocket 21 is made from a durable plastic material. The sprocket 21 is located on the outside of the chain 14 and extends within the slot 15*c* of the track 15 to engage with the chain 14. The sprocket 21 is uniquely designed such that a constant angular velocity of the sprocket results in a constant linear velocity of the chain 14. This prevents "jerky" motion of the chain 14 that would result using a conventional sprocket, as discussed in more detail below. That is, it has been found that in using a conventional sprocket the constant angular velocity of the sprocket would result in an acceleration and deceleration of the chain.

Figure 4:
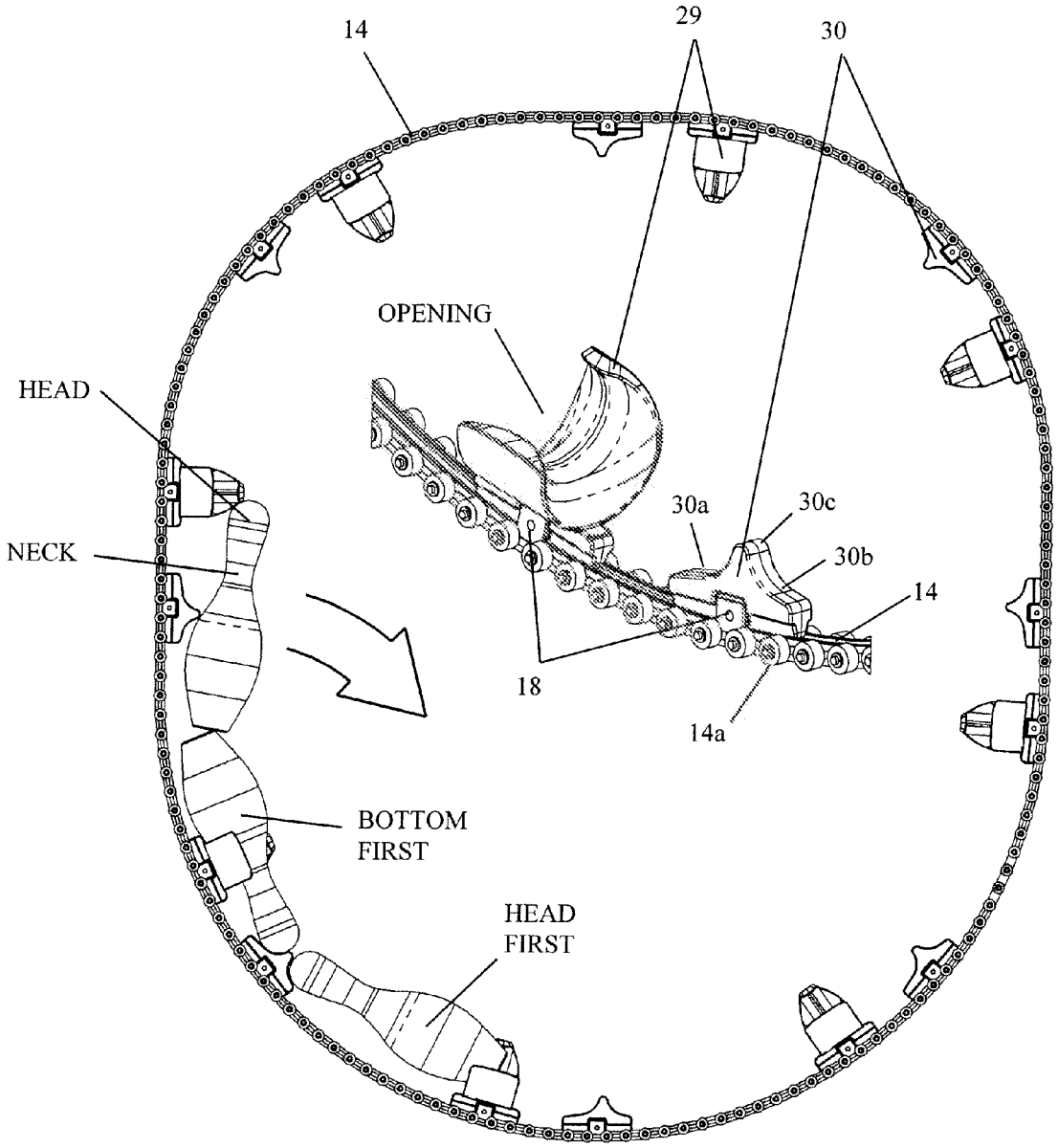
FIG. 4 shows the chain and components, as well as demonstrating their function in accordance with embodiments of the invention.

FIG. 4 shows the chain and components, as well as demonstrating their function in accordance with embodiments of the invention. In particular, the chain 14 includes a plurality of "C" shaped pin carriers or "flight cups" 29 and a plurality of chain attachments or "flight tabs" 30 used in tandem with the flight cups 29. In embodiments, the chain 14 is about 200 inches with a spacing between links of about 1.25 inches; although it should be understood that other chain lengths and number and spacing of the flight cups 29 are also contemplated by the invention, depending on the size of the bowling pins, the configuration of the belt with relation to the pinspotter, etc. The plurality of flight cups 29 and plurality of flight tabs 30 can be connected to the chain 14 through its linkages, more specifically specialized links called chain tabs 15*i*. The chain 14 also is shown to include a plurality of rollers 14*a*, which are designed to ride on the track.

In embodiments, the flight cups 29 have an opening that is sized to allow a neck and/or head of the pin to pass there through. The plurality of flight cups 29 are oriented in such a way that the opening is facing towards the pins on a pin conveyor belt. This allows the pins to be captured in the plurality of flight cups 29, in either orientation (direction). The spacing between the plurality of flight cups 29 can be about 25" inches so that two pins can be seated therein, and is spaced such that the heads of the pins rest on the flight tabs 30 at certain locations within the rotation of the chain 14 (e.g., arcs, curves or corners). This spacing provides a minimum interval spacing pins at about 1.7 seconds required for a conventional distributor to operate correctly. It also provides enough room for sequential bottom and head first pins to fit into the curved sections of the chain track assembly 3.

The spacing of the pins and location thereof in the plurality of flight cups 29 ensures that the pins will exit through the opening of the front panel at an even interval. This ensures that the pins will enter the distributor at a specific time interval (based on the movement of the distributor) so that the pins can be properly and timely placed within the appropriate space in the pinspotter. For example, it takes time for the distributor to index from one bin pocket location to the next and if this interval is too short (e.g., <1.5 sec) the distributor may feed two pins (double pin feed) into one bin pocket resulting in a machine "stop" and the need for human intervention to physically correct the error. However the spacing of the plurality of flight cups 29, and timing of the belt movement will prevent such stoppage.

As shown in FIG. 4, the flight tabs 30 prevent a scenario where two pins, end to end, can be transported through the elevator system causing a feed error. The flight tabs 30 are also structured and designed to cradle the heads of the pins, for example, at arcs, curves or corners of the chain 14. The plurality of flight tabs 30 also ensures that only one pin at a time can occupy each cup position. Also, in use, the plurality of flight tabs 30, should any pin be lifted but not seated within the plurality of flight cups 29, will push the unseated pin away from the chain 14, causing it to fall back to the pin conveyor belt, thereby preventing a jam. To accomplish these functions/features, the flight tabs 30 include a first section 30*a* and a second section 30*b*, divided by a smoothly transitioned protrusion 30*c*. The first section 30*a* has a length larger than the second section 30*b*. This configuration allows either the head or the bottom of the pin to rest thereon, regardless of its orientation, and make contact with the protrusion 30*b* at certain times during the rotation of the chain (e.g., at the arcs or curves of the looped track).

Figure 5:
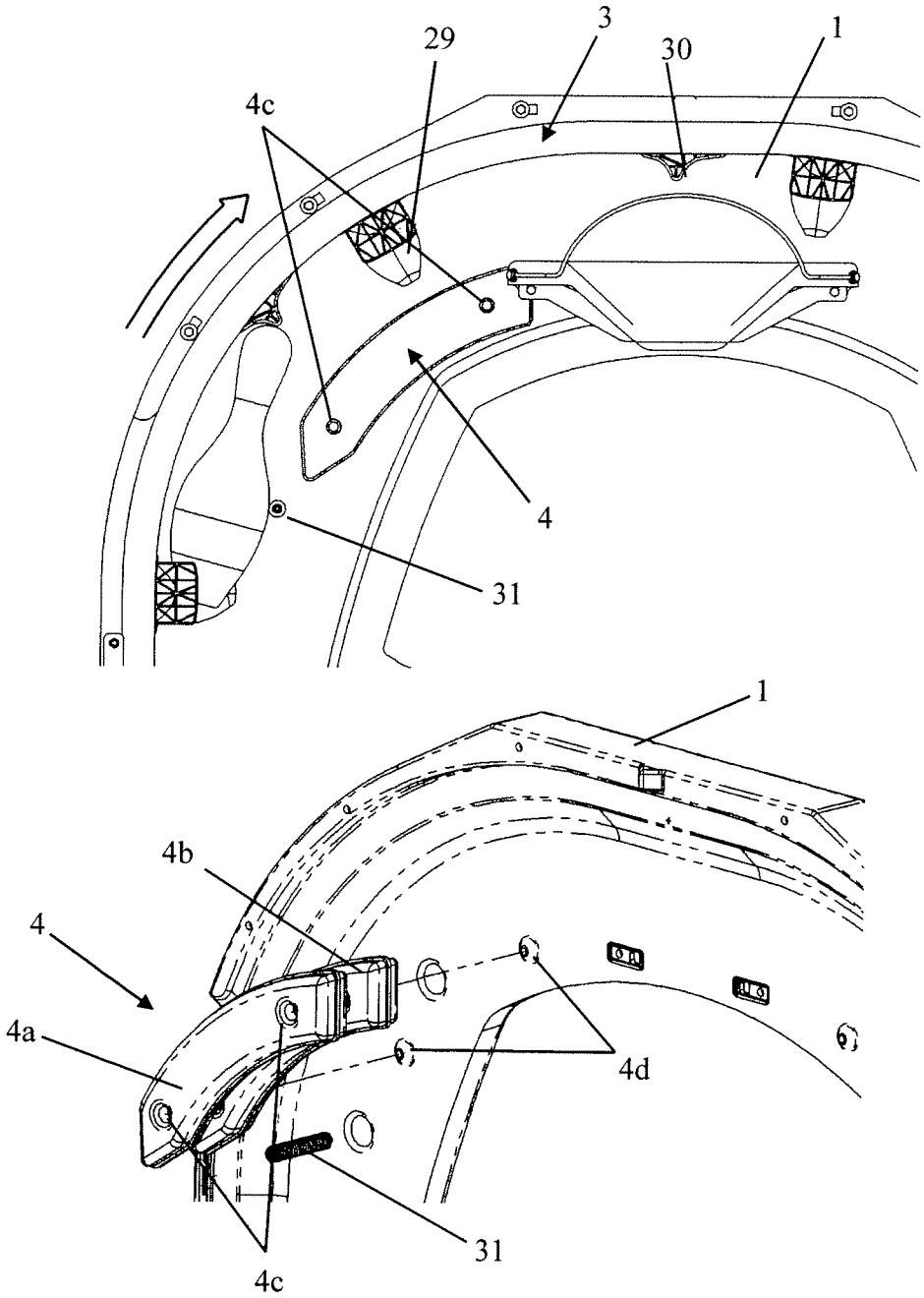
FIG. 5 shows carrier rails in accordance with embodiments of the invention.
Figure 6:
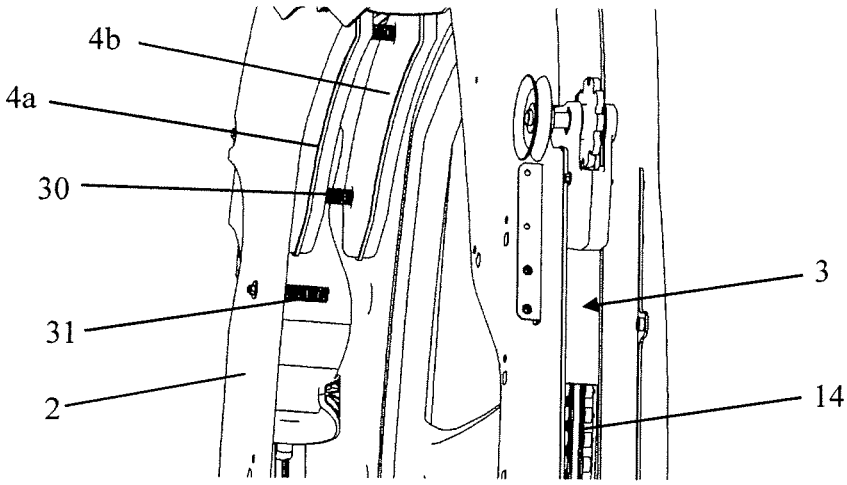
FIG. 6 shows a break-away spring in accordance with embodiments of the invention.

FIGS. 5 and 6 show the carrier rails 4 in accordance with embodiments of the invention. The carrier rails 4 are structured and designed to support the bowling pins as they transition from the vertical path of the oval pin channel to the orientor pan 5 (also shown in FIG. 1 and FIG. 7) and front panel opening 2*a*, located at the top of the pin channel. The carrier rails 4 include two rails 4*a*, 4*b*, which have conical mating features 4*c* which match opposing protrusions 4*d* in the panels (front and rear) in order to hold the assembly in place passively by two springs 30 compressed between the two rails 4*a*, 4*b*. In an alternative embodiment, the two rails 4*a*, 4*b*, have protrusions which match with opposing conical features in the panels (front and rear) in order to hold the assembly in place passively by the two springs 30 compressed between the two rails. In either scenario, this creates a "pop-in" "pop-out" tool-less installation and removal of these components for cleaning the upper inside walls of the panels. It also allows for additional rails on the opposite side of the o-pan for circulating pins and for rapid installation and removal of specialty pin cleaning attachments.

As an alternative and as further represented by reference numeral 4, the elevator assembly 100 can substitute the snap in carrier rails with a cleaning apparatus (brush) which would clean the bowling pins as they circulate through the elevator assembly 100. This eliminates the need to remove the pins from the pinspotter for cleaning. The apparatus (cleaner) can be a brush assembly that fits within the same protrusions (or conical features) of the panels 1, 2. By a simple substitution, the cleaning apparatus can be installed by removing the carrier rails (pinching them together), and replacing them with the cleaning apparatus.

As further shown, a compression spring 31 is located below the carrier rails 4 to act as a break-away for bowling pins moving head first up the elevator assembly 100 that may jam against the leading edge of the carrier rails 4 for instances when the pin is not fully seated in the flight cup 29. This compression spring 31 causes the pin to either continue onto the carrier rails 4 or fall back into the pit. (See, e.g., FIGS. 5 and 6.) The compression spring 31 is attached to the front panel 2 by a bolt and nut assembly, for example. Other attachment mechanisms such as a rivet, etc. can also be used to attach the compression spring 31. Other materials and geometries for 31 are contemplated by the invention.

Figure 7:
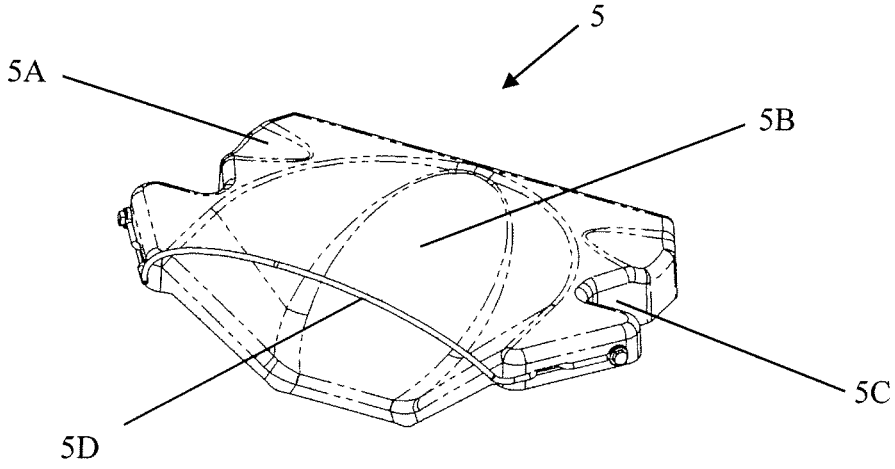
FIG. 7 shows an orientor pan (o-pan) and hoop in accordance with embodiments of the invention.

FIG. 7 shows an orientor pan (o-pan) and hoop in accordance with embodiments of the invention. In embodiments, the o-pan 5 is symmetrical and includes a guide plateau 5A and funnel shaped surface 5B. The o-pan 5 includes a notch 5C that seats within the exit opening (2*a*) of the front panel (2). The o-pan 5 can be secured with screws or otherwise attached to the panels with other fastening mechanisms. The elevator assembly, being of an oval shape, can be taller than the conventional pin wheel elevator so that the o-pan 5 can have a steeper fall away angle (e.g., approximately 22° off horizontal) than existing o-pans. This ensures that the pins will exit from the elevator properly and not become jammed. Also, the o-pan 5 can be located 2-3 inches above the distributor belt to allow better and more positive transition of the bowling pin to the distributor, although other dimensions and locations are contemplated by the invention.

The function of the o-pan is to ensure that pins exiting the elevator 100 by means of the pin exit 2*a* do so such that the pins transfer from the elevator assembly 100 to the distributor bottom first regardless of the orientation of the pin as it was lifted within the elevator, e.g. a first orientation of head first or a second orientation of bottom first. The specially designed geometry (e.g., guide plateau 5A and funnel shaped surface 5B) of the o-pan 5 allows the head of the pin to continue past the opposite edge of the pin exit (e.g., opening 2*a*) to always exit belly first, as discussed more specifically with reference to FIGS. 8A-8F. For example, when bowling pins reach the o-pan 5 head first, the special designed geometry of the o-pan 5 allows the head of the pin to continue past the opposite edge of the pin exit opening. When the belly of the bowling pin glides over the guide plateau 5A of the o-pan 5, the pin rolls bottom first down the middle of the pan while the head of the pin is delayed by the edge of the pin exit opening causing the pin to exit onto the distributor bottom first. If a pin approaches bottom first, it simply rolls down the center of the pan bottom first onto the distributor, hence the term "orientor" (orientation) pan. The o-pan 5 can include a metal wire form 5D (or could be another material) which prevents pins exiting the top of the elevator assembly 100 from spinning and landing on the distributor belt head first (in opposition to the preferred orientation of bottom first).

Figure 8A:
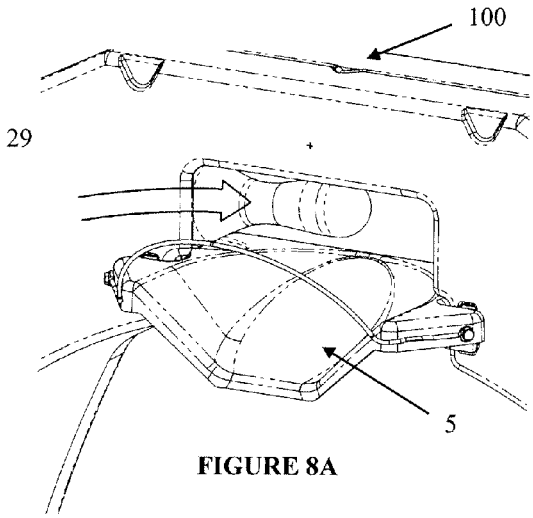
FIGS. 8A-8F show a sequence of a bowling pin exiting from the opening of a front panel in accordance with embodiments of the invention.
Figure 8B:
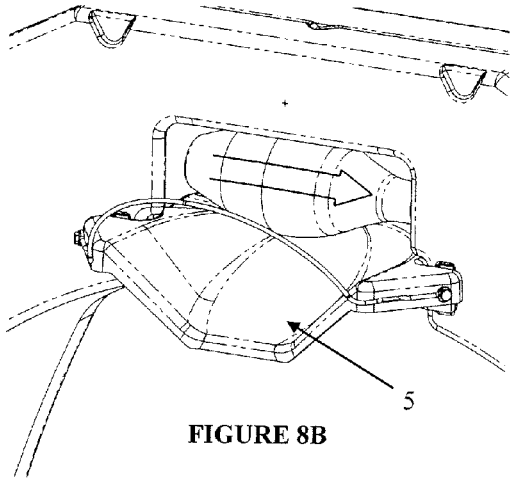
Figure 8C:
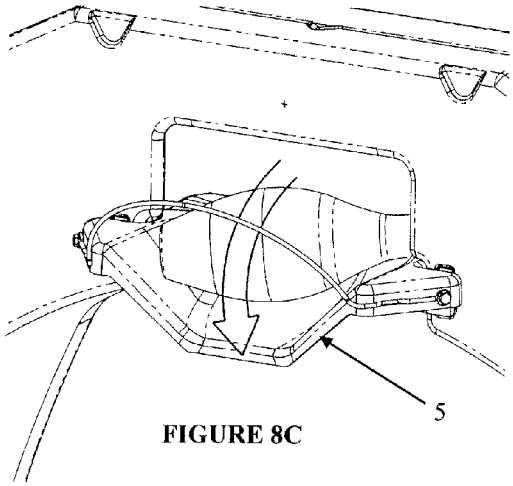
Figure 8D:
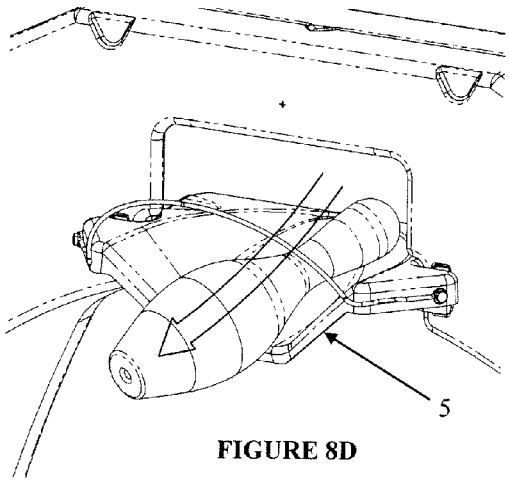

FIGS. 8A-8F show a sequence of a bowling pin exiting the opening 2*a* of the front panel 2. Although the elevator assembly 100 is shown running clockwise, it is understood that the assembly can also run counterclockwise, depending whether the assembly is a right or left unit. In FIG. 8A, the pin is moving head first toward the opening 2*a*. As the belly of the pin rides over the guide plateau of the o-pan, the head of the pin is maintained in-line with the chain track such that the head of the pin travels past the pin exit/opening 2*a*. In FIG. 8B, the head of the pin has moved past the opening 2*a* and the belly of the pin has traversed the guide plateau 5A and is passively released from the flight cup 29. In FIG. 8C, the belly of the pin rolls onto the sloped surface 5B. The head of the pin is blocked by the front panel 2, facilitating the rotation of the pin down the sloped surface 5B of the o-pan 5. In FIG. 8D, the pin slides out, bottom first, towards the distributor.

Figure 8E:
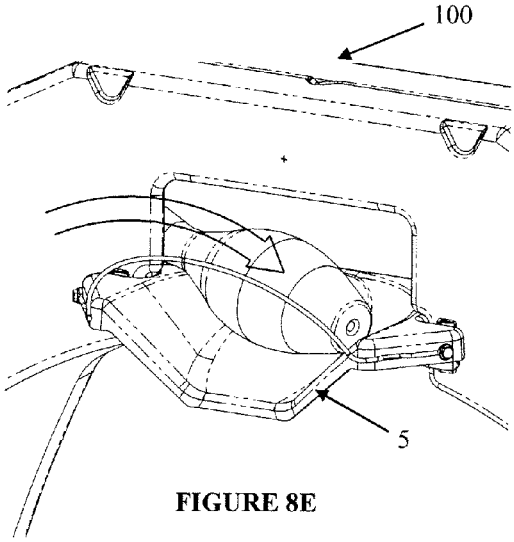
Figure 8F:
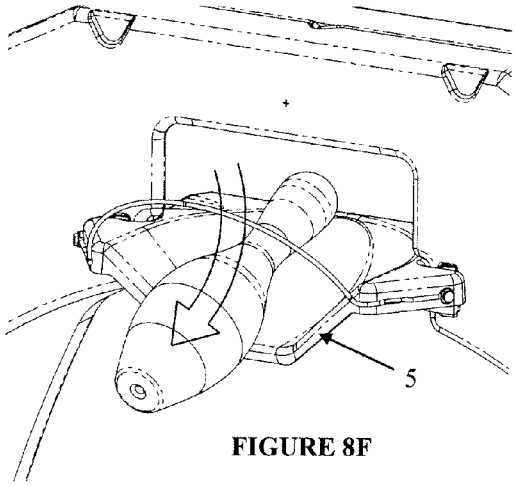

In FIG. 8E, the pin is traveling bottom first. Much like in FIG. 8A, at about the time the pin reaches the opening 2*a* of the front panel, the pin is passively released from the flight cup 29. The bottom of the pin will contact the sloped surface 5B and will roll out bottom first down the o-pan 5. In FIG. 8F, the pin slides out bottom first, towards the distributor.

Figure 9:
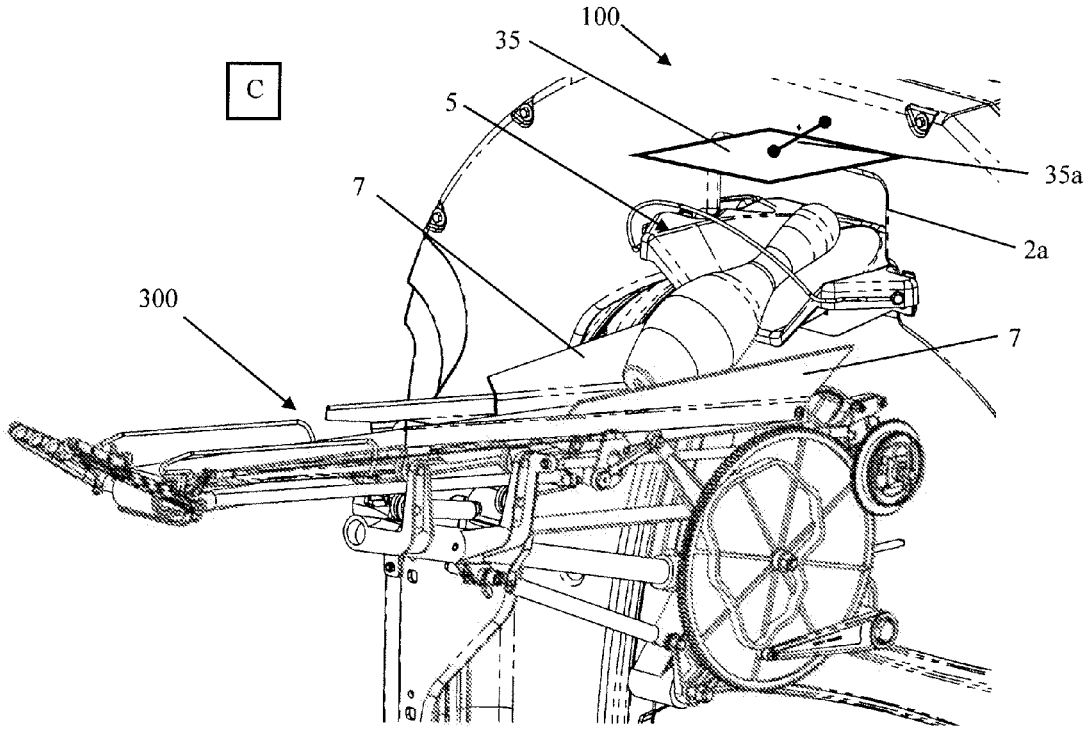
FIG. 9 shows guide plates and o-pan in relation to a front panel in accordance with embodiments of the invention.

FIG. 9 shows distributor guide plates and the o-pan in relation to a front panel in accordance with embodiments of the invention. As shown in this figure, the stationary o-pan 5 mounts to the front panel 2, below the exit opening 2*a*. As shown, right and left guide plates 7 are attached to an existing distributor 300 to funnel the bowling pins exiting the elevator and stationary o-pan 5 onto the distributor 300. The guide plates 7 can be, for example, two triangular shaped panels attached to the distributor 300 without the need for additional hardware. In embodiments, the guide plates 7 can be about 20" to 24" inches in length; although other dimensions are also contemplated by the present invention. The elevator assembly 100, being of an oval shape, can be taller than the conventional pin wheel elevator so that the o-pan 5 can have a steeper fall away angle than existing o-pans. This ensures that the pins will exit from the elevator properly and not become jammed. Also, the o-pan 5 can be located 2-3 inches above the distributor 300 to allow better and more positive transition of the bowling pin to the distributor, although other dimensions and locations are contemplated by the invention.

In alternate embodiments, the exit opening 2*a* can be blocked by, for example, a gate 35 which can be opened and closed at certain intervals. This allows only certain pins to be loaded in the pinspotter at certain locations. The gate 35 can be opened and closed by a conventional solenoid actuator 35*a*, controlled by a control system (C). The gate 35 can be used for novelty type games, e.g., having 6 pins at certain locations. This can also be used by professionals or other enthusiasts to practice "knocking down" certain pin combinations. More specifically, to have the selective pin spotting, the elevator assembly 100 can been designed to re-circulate pins to the pit by the addition of the gate 35 that blocks the exit of pins from the elevator into the distributor. The pins would ride over the stationary o-pan 5 and down the other half of the elevator back into the pit. An electro-mechanical device (or controller) can be used to index the distributor to a selected bin pocket position at which time the exit gate 35 can be opened allowing a pin feed to that bin pocket position. This can be repeated for any combination of pins allowing the bowler to select a combination of pins to be set on the pin deck.

Figure 10:
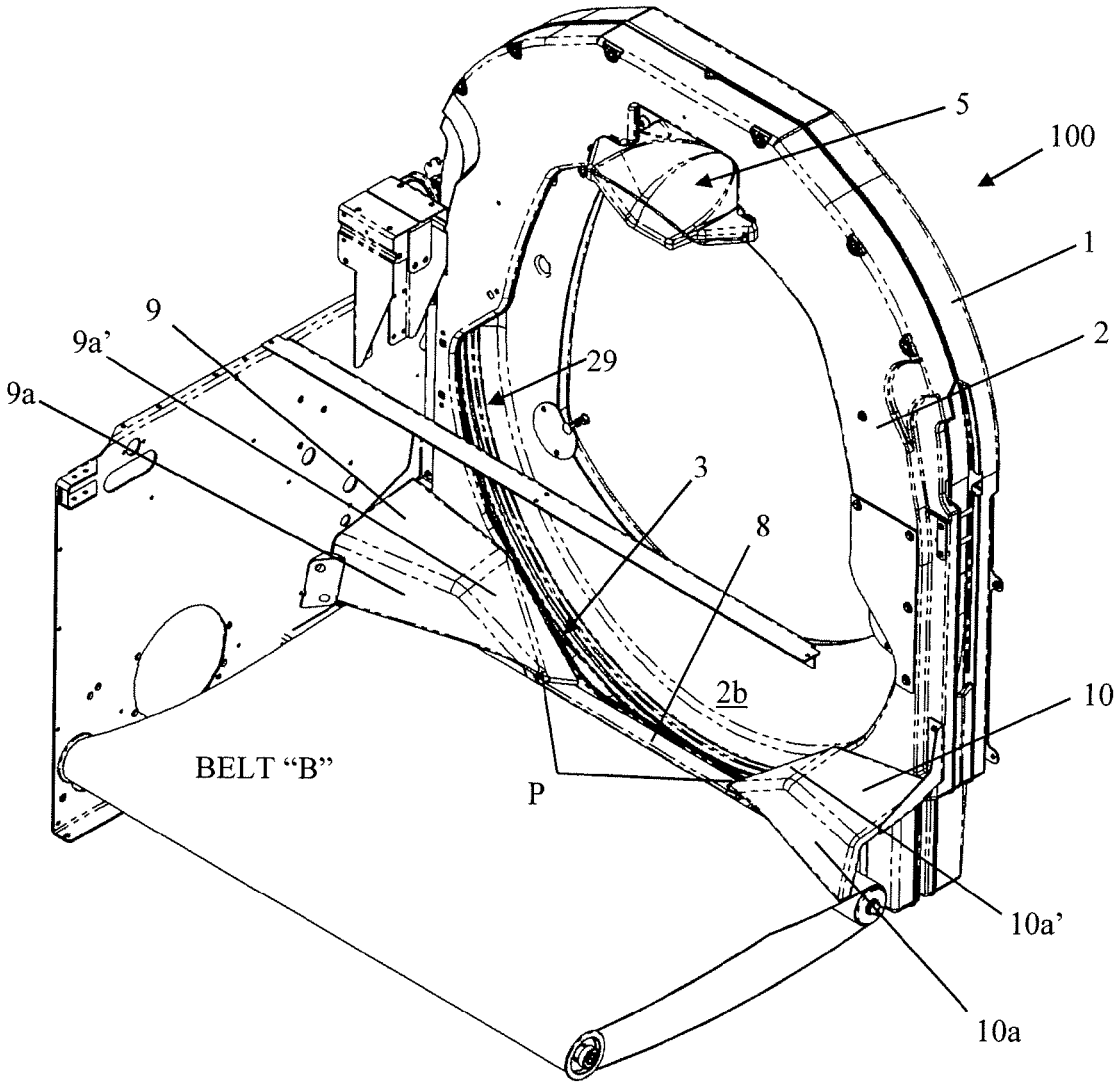
FIG. 10 shows plow components in accordance with embodiments of the invention.

FIG. 10 shows plow components in accordance with embodiments of the invention. More specifically, as shown in FIG. 10, the front panel 2 has a cutout 2*b* at the bottom which optimizes the entrance of bowling pins from the pin conveyor belt "B" and enhances the capture of pins by the flight cup for efficient pin feed. Attached to the face of the front panel 2 are three plow components 8, 9, 10 which help funnel the pins into the elevator entrance (e.g., opening 2*b*). The center plow 8 is a "bridge" between the pin conveyor belt "B" and the opening 2*b* of the front panel 2. The center plow 8 also supports and provides partial mounting for the "right" and "left" hand plows 9, 10, which are designed to funnel the pins into the center opening of the elevator assembly 100. The geometry of the right and left hand plows 9, 10 works in conjunction with the unique shape of the opening 2*b* in the front panel 2 to ensure proper capture of the bowling pins by the flight cup 29 and thus optimize the feed rate of pins to the distributor. The opening between the left and right plows is larger than a length of a bowling pin.

Still referring to FIG. 10, the left and right plows 9 and 10 are funnel shaped, with angular end portions 9*a*', 10*a*'. The angular end portions 9*a*', 10*a*' funnel the pins into the pin pick up area. The funnel shaped portion 9*a*', 10*a*' slope inwards towards the opening 2*b*, but are otherwise substantially flat surfaces. The portion 9*a*' includes a compound surface, e.g., two sloped surfaces that meet at point "P". Also, the surfaces 9*a* and 10*a* are flat surfaces that meet at the same point "P" as the surfaces of the angular end portions 9*a*', 10*a*'. As such, plow 9 includes at least three surfaces that meet at a single point "P"; similarly, plow 10 includes at least three surfaces that meet at a single point "P". Additionally, unlike conventional plows that are angled upwards, the flat surfaces 9*a* and 10*a* do not project or deflect high velocity pins entering the pit from the pin deck/lane surface in a vertical direction within the pinspotter. Advantageously, this reduces pin damage and jams, from the pins being ricocheted around within the pit area or into the elevator assembly 100.

FIGS. 11A-11D show various views of the flight cup geometry in accordance with embodiments of the invention. It should be understood that the dimensions shown in FIGS. 11A-11D are illustrative of examples used preferably with a regulation bowling pin as shown in FIG. 12, for example. It should be understood that the dimensions of the flight cup 29 of the present invention can also be scaled for bowling pins used in non-regulation application such as, for example, Highway 66™ or ThunderBowl™, both of which are manufactured by QubicaAMF® Worldwide. In such instances, the dimensions of the flight cup 29 can be calculated by multiplying the dimensions noted herein by a ratio of the bowling pins used in a non-regulation application to the regulation bowling pins shown, for example, in FIG. 12. Also, it should be understood that the dimensions provided herein, although important for certain applications, should not be considered a limiting feature, in that the overall functionality of the flight cups should be considered in the design and manufacture of such components. For example, the flight cups 29 should be designed so that:

(i) The bowling pins can be seated within the flight cup 29 from either orientation, e.g., bottom first or head first.

(ii) Only a single bowling pin can be seated within the flight cup 29 at one time.

(iii) A neck of the bowling pin can enter through an opening formed in the flight cup 29 so that the bowling pin can be seated within the flight cup, head first.

(iv) The same flight cup 29 can be used in an elevator assembly that is rotating in either a clockwise or counterclockwise direction.

(v) The bowling pin can be seated within the flight cup 29 such that a predetermined location of the bowling pin is a certain distance away from the centerline of the flight cup.

More specifically, the configuration of the plurality of flight cups 29 has been found to most efficiently allow the pins to be seated therein, regardless of the pin orientation. For example, in embodiments, the plurality of flight cups 29 are structured and designed to hold bowling pins from either a top portion or a bottom portion. That is, the plurality of flight cups 29 handle the bowling pins by the fat portion (or belly) of the pin, head-up or head-down, eliminating the uneven spacing that would be caused by the extra length of the neck/head if the pins were simply pushed from the end. The plurality of flight cups 29 has dimensions such that a center of the bowling pin body, regardless of its orientation, will be at an approximately same distance from a center line of the respective flight cup 29. This ensures that the time interval per bowling pin (e.g., 1.5 to 2.0 sec/pin.) is maintained. Also, the flight cups 29 are structured and designed in such a manner as to allow the pins to be released therefrom when the pins are at an uppermost or substantially uppermost position of the chain track assembly 3, near the opening of the front panel. The flight cup 29 can be made from a thermoplastic (e.g., plastic); although other materials are also contemplated by the present invention.

Figure 11A:
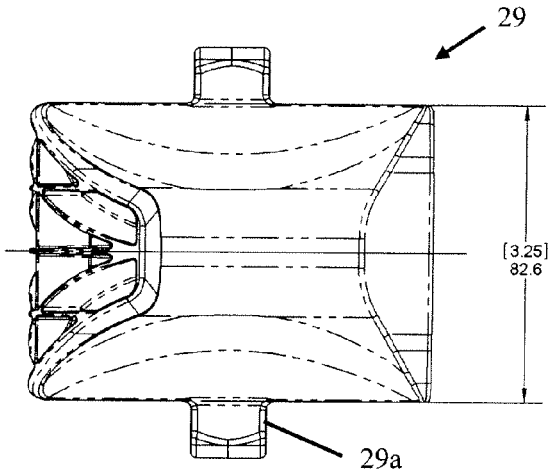
FIGS. 11A-11D show various views of a flight cup geometry in accordance with embodiments of the invention.
Figure 11B:
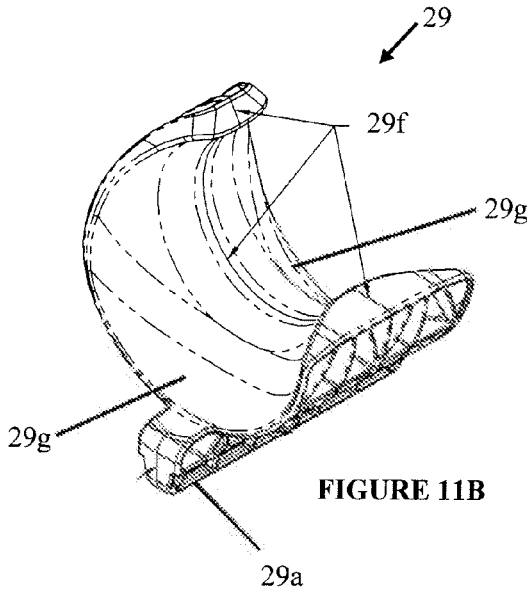
Figure 11C:
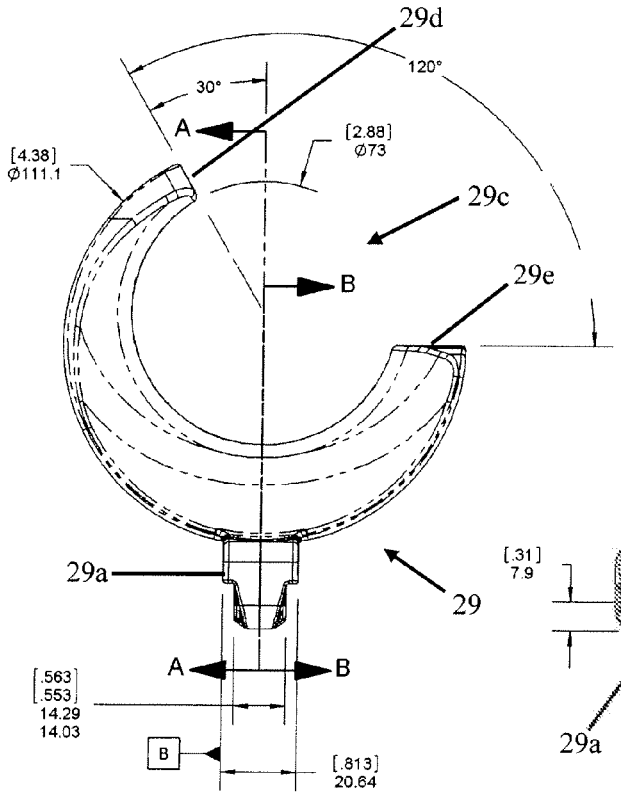
Figure 11D:
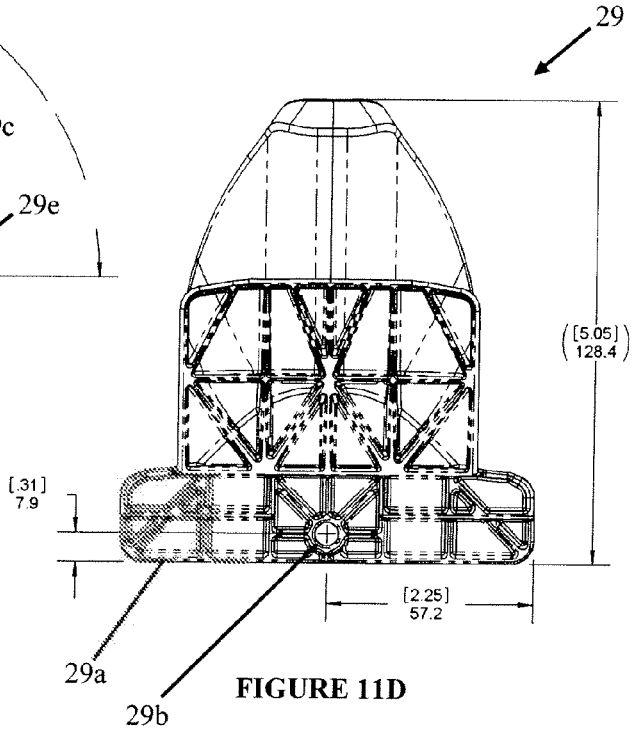
Figure 12:
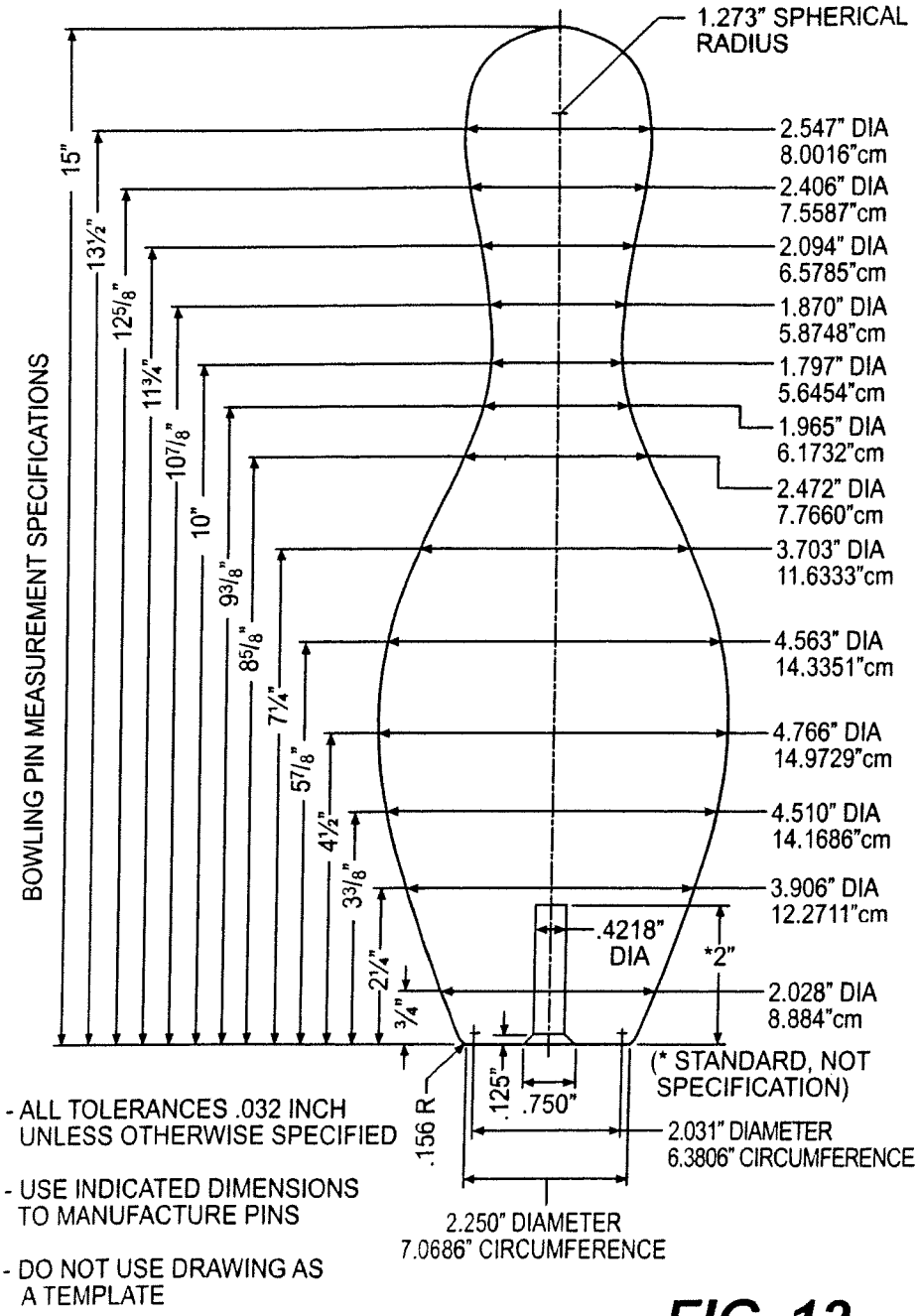
FIG. 12 is representative of a regulation bowling pin.

As shown in FIGS. 11A-11D, the flight cup 29 includes a tab 29*a* which can be used to mount to the chain. The tab 29*a* is dimensioned to ensure that it fits within an opening of the track (e.g., opening 15*h* formed between the foil led sections 15*a* shown in, for example, FIG. 2B). For example, the tab 29*a* can have a stepped width of about 0.8 inches and 0.55 inches as shown in FIG. 11C; although these dimensions are dependent on the size of the opening 15*h* shown in FIG. 2B. The tab 29*a* extends from a bottom of the flight cup 29, and can include, for example, a hole 29*b* (see, e.g., FIG. 11D). The hole 29*b* can be used to mate with a link of the chain, for coupling the flight cup 29 to the chain. In embodiments, a center of the hole 29*b* can be about 2.25 inches from an edge of the tab 29*a*, and about 0.31 inches from a bottom of the tab. These dimensions also can vary, depending on the size and dimensions of the chain track assembly. The height of the flight cup 29 is about 5 inches, but can also vary depending on the size and dimensions of the chain track assembly and bowling pin.

As shown in FIG. 11C, the flight cup 29 has an outside surface that is substantially circular, with an opening 29*c*. The opening 29*c* is defined by two edges 29*d* and 29*e*. In embodiments, the opening 29*c* faces toward the pin conveyor belt and is designed to maximize the ability to pick up and seat pins therein. The opening 29*c* is dimensioned slightly larger than a neck and/or head of a bowling pin. For example, the opening is about 120° or can be about 2.9 inches. As measured from a vertical centerline (as would be mounted to the chain), the edge 29*d* of the wall forming the opening 29*c* is about 30° off center; whereas, the edge 29*e* of the wall forming the opening is about 90° off center. This orientation and dimension allows the bowling pin to be easily seated, in either orientation (e.g., head first or bottom first), within the flight cup 29. The outside diameter is about 4.4 inches.

As shown FIG. 11B, in embodiments, the flight cup 29 includes a parting line or center ridge 29*f* provided on an interior surface 29*g*. The interior surface 29*g* slopes away from the parting line 29*f* on either side. The flight cup 29 has an inner diameter at the center ridge 29*f* of about 2.9 inches, for use with regulation pins. In embodiments, the center ridge 29*f* has a smaller diameter than other portions of the flight cup 29 to ensure that the pin can be seated therein and will not slip/pass entirely there through. As discussed above, the shape of the exemplary flight cup 29 allows for a center of the pin body to be at an approximately same distance from the flight cup 29 regardless of its orientation. As shown in FIG. 11A, the flight cup 29 can be about 3.25 inches wide.

Figure 13A:
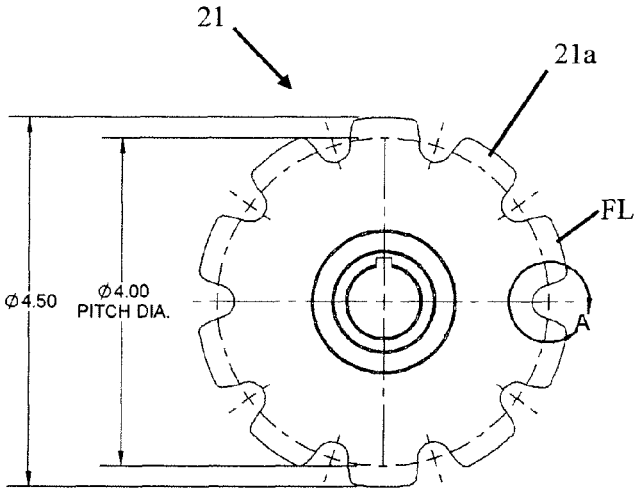
FIGS. 13A-13C show various views of a drive sprocket and tooth profile geometry in accordance with embodiments of the invention.
Figure 13B:
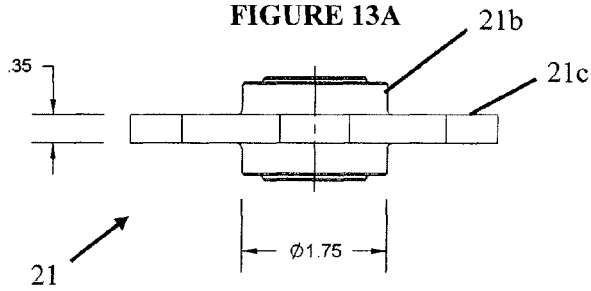
Figure 13C:
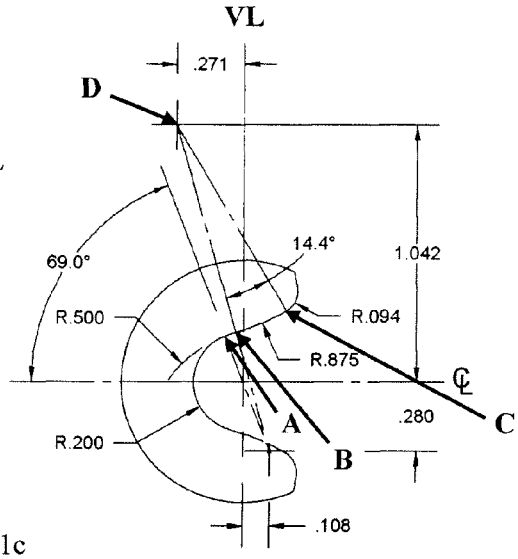

FIGS. 13A-13C show various views of the drive sprocket 21 and its tooth profile geometry in accordance with embodiments of the invention. The unique configuration of the sprocket ensures proper engagement with the chain, as well as ensures that the constant angular velocity of the sprocket is translated into a constant linear velocity of the chain, e.g., eliminates acceleration and deceleration of the chain. This will allow a smooth motion of the chain, for example.

The drive sprocket 21, in one embodiment, is about 4.5 inches in diameter, and has a pitch diameter of about 4.0 inches. In embodiments, the drive sprocket 21 includes 10 teeth 21*a*. The hub 21*b* has a diameter of about 1.75 inches. The thickness of the body 21*c* is about 0.35 inches.

The tooth profile is shown in FIG. 13C. The tooth profile includes a first radius of about 0.2, which has an arc length of 69° as measured from a horizontal centerline CL to a point "A" on the tooth. Immediately adjacent and transitioning from the first radius is a second radius of about 0.50 to a point "B". Immediately adjacent and transitioning from the second radius is a third radius of about 0.87 having an arc length of about 14.4°, as measured from point "B" to point "C". Point "D" is about 1.04 inches above the horizontal centerline CL and 0.27 inches from a vertical centerline VL. Immediately adjacent and transitioning from the third radius is a fourth radius of about 0.094, which transitions into a flat portion FL of the tooth. This radius is compared to a sharp transition of a conventional chain tooth. Additionally, the teeth have a substantially flat surface. This tooth profile ensures that at least two teeth are contacting the chain at all times, which has a distance between centerlines of adjacent links of about 1.25 inches, and a diameter of about 0.40 inches. This ensures that the chain does not jump or a link is not missed during rotation as it is being driven by the sprocket 21. Also, this arrangement ensures that there is no acceleration or deceleration of the chain, during normal operations.

Figure 14:
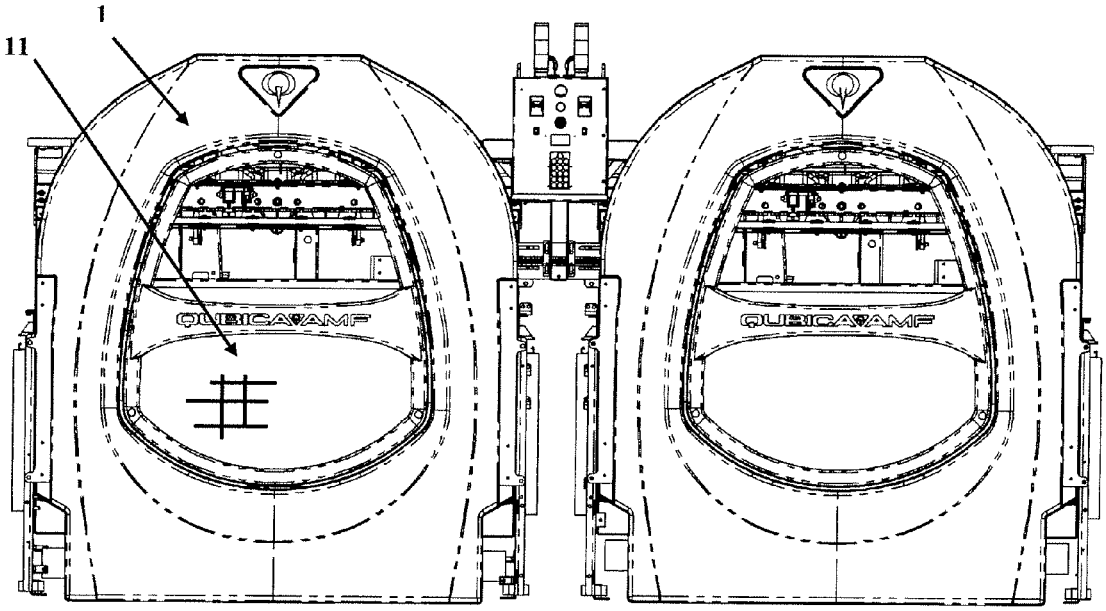
FIGS. 14 and 15 show rear views of the elevator assembly in accordance with the invention.
Figure 15:
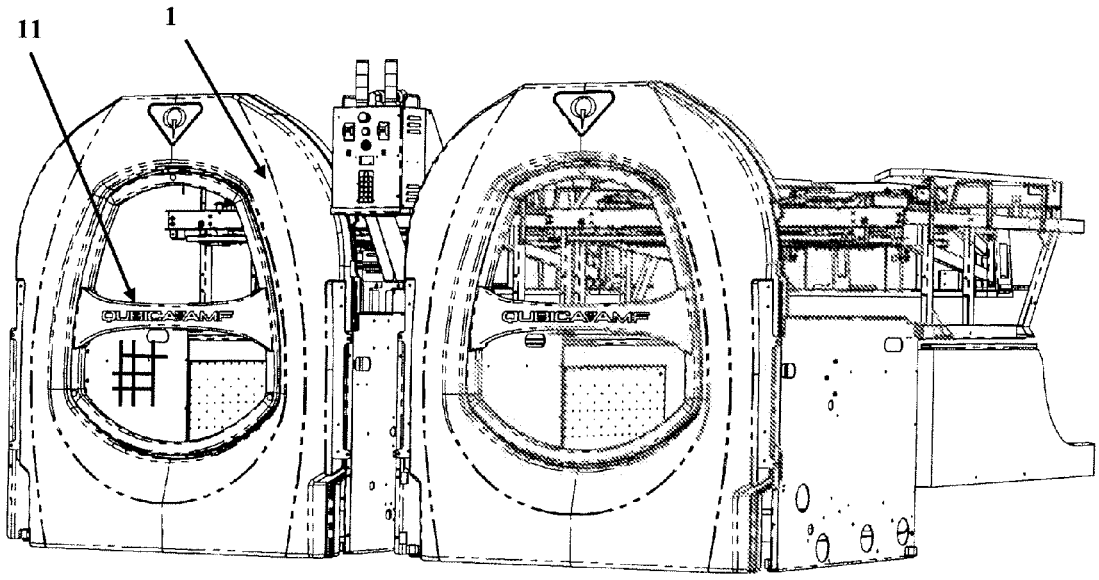

FIGS. 14 and 15 show the rear panel 1 of the elevator assembly 100. The rear panel 1 forms one half of the internal mechanical housing, and also replaces the current pin wheel cover. The back side of the rear panel 1 aesthetically defines the appearance of the QubicaAMF® pinspotter. The rear panel 1 includes a guard assembly 11 that can be easily removed. Removal of the guard assembly 11 allows access to the elevator assembly 100 for ease of maintenance, repair etc. In fact, due to the size of the opening, it is now possible to enter through the rear of the pinspotter to repair other components such as, for example, the distributor and the ball stop cushion.

In further embodiments, the elevator assembly 100 is non-metallic and eliminates the high frequency noise associated with the current metal pinwheel. Output decibels have thus been reduced, compared to conventional systems. The elevator assembly 100 is designed to fit QubicaAMF pinspotter models from 82-70 through current 90XLi series (and can be retrofitted to be assembled as a kit for other pinspotters, as well as those mentioned above). To this end, the elevator assembly 100 can be sold/used for new pinspotters, and also be available as an upgrade to existing pinspotters. The elevator assembly 100 can also replace the current metal "pin wheel" and metal "plows" with high impact strength "twin sheet" thermoformed thermo-plastic-olefin (TPO) and injected molded impact modified polymer plastic components. The elevator assembly 100 also significantly increases bowling pin life by eliminating dents, cuts, and wear caused by the prior art metal plow, elevator and distributor components. The elevator assembly 100 is modular and can be removed from the backend of the pinspotter as one unit including the plows. This makes servicing the pin conveyer belt and cushion components in the pit area much easier.

The elevator assembly 100 additionally is universal in design and can be assembled "right hand" or "left hand" for operation on either machine of a pinspotter pair. The elevator assembly 100 has a center opening which is significantly increased over conventional systems, allowing better access to the distributor for servicing and pit access for clearing jams and cleaning. The elevator assembly 100 has no adjustable components, and operates correctly as assembled.

Also, the elevator assembly 100 has been designed to allow for Horizontal Pin Distribution. To accomplish this feature, the elevator assembly 100 can be raised and moved forward to allow pin elevation to a horizontally oriented distributor. This will also shorten the overall length of the pinspotter and eliminate the need for a 4" center plow section between the rear pin conveyor belt roller and the elevator. Raising the elevator assembly 100 can be accomplished also by lengthening the oval aspect of the chain, for example. This has the advantage of increasing the amount of pins that can be held and elevated by the elevator assembly 100.

It is noted that the foregoing examples have been provided merely for the purpose of explanation and are in no way to be construed as limiting of the present invention. While the present invention has been described with reference to an exemplary embodiment, it is understood that the words, which have been used herein, are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An elevator assembly, comprising:

a looped track assembly;

a chain assembly having rollers which roll on the looped track assembly, the chain assembly comprises spaced apart pin holders alternating with tabs, each of which are extending from the chain; and a sprocket drive assembly which engages the chain assembly, wherein:

the pin holders have an opening structured to pick up and hold a bowling pin entering from a first orientation which is head first and a second orientation which is bottom first; and the alternating tabs are structured to support a head of the bowling pin and are positioned such that a tab of the alternating tabs is positioned a first distance from a pin holder holding the bowling pin entering from the first orientation and a second distance from a pin holder holding the bowling pin entering from the second orientation, where the second distance is larger than the first distance.

2. The elevator assembly of claim 1, wherein:

the alternating tabs and pin holders extend from the chain to an inside of the looped track assembly; and the sprocket drive assembly engages the chain assembly from outside an outer circumference of the looped track assembly.

3. The elevator assembly of claim 1, wherein the looped track assembly is an oval track having a height larger than a width.

4. The elevator assembly of claim 1, wherein the rollers are fully encapsulated within the looped track assembly.

5. The elevator assembly of claim 1, wherein the looped track assembly is a thermoplastic material.

6. The elevator assembly of claim 1, wherein:

the looped track assembly is two parts joined together by a plurality of joiners; and the plurality of joiners are fitted within a formed section of the looped track assembly.

7. The elevator assembly of claim 1, wherein the sprocket drive assembly mates with the chain assembly through a slot on an outer circumferential surface of the looped track assembly.

8. The elevator assembly of claim 7, wherein:

the sprocket drive assembly includes a sprocket and a driven sheave driven by a driving sheave; and the sprocket drives the chain from an outside of the looped track assembly.

9. The elevator assembly of claim 8, further comprising a belt back-wrapped around the driven sheave by approximately 90°, which acts as a clutch mechanism.

10. The elevator assembly of claim 9, further comprising an adjustable idler pulley which is structured to adjust a tension of the belt about the driven sheave.

11. The elevator assembly of claim 8, wherein the sprocket has a radial tooth profile structured to eliminate acceleration and deceleration of the chain.

12. The elevator assembly of claim 1, further comprising one or more wear sleeves fitted into a notch of the looped track assembly, the one or more wear sleeves being opposed to a sprocket of the sprocket drive assembly.

13. The elevator assembly of claim 1, wherein the looped track assembly comprises a slot and ramp system for accommodating any slack of the chain.

14. The elevator assembly of claim 1, further comprising front and rear panels for holding the looped track assembly.

15. An elevator assembly, comprising:

a looped track assembly;

a chain assembly having rollers which roll on the looped track assembly, the chain assembly comprises spaced apart pin holders alternating with tabs, each of which are extending from the chain;

a sprocket drive assembly which engages the chain assembly;

front and rear panels for holding the looped track assembly; and carrier rails and a spring to expand the carrier rails between the front and rear panels.

16. The elevator assembly of claim 15, wherein the carrier rails and the front and rear panels include corresponding projections and indentations for holding the carrier rails in place between the front and rear panels.

17. The elevator assembly of claim 14, further comprising a break away spring mounted to one of the front and rear panels.

18. The elevator assembly of claim 14, further comprising a stationary orientor pan mounted to the front panel, aligned with an opening therein.

19. The elevator assembly of claim 18, wherein the orientor pan has an angle of about 22° off horizontal.

20. The elevator assembly of claim 19, further comprising distributor guide plates mounted to a distributor and in alignment with the stationary orientor pan, which leads to the distributor.

21. The elevator assembly of claim 14, further comprising plows mounted to a front face of the front panel, the plows having a substantially flat surface at an angle of about 20 degrees respective to an XY Plane and 75 degrees respective to an XZ plane.

22. The elevator assembly of claim 1, wherein the pin holders have a geometry that is a "C" shape holder.

23. The elevator assembly of claim 22, wherein the C shape holder includes a central ridge and the opening.

24. The elevator assembly of claim 22, wherein the C shape holder is structured to pick up and accommodate pins entering from either the first orientation which is head first or the second orientation which is bottom first.

25. The elevator assembly of claim 22, wherein the C shape holder is structured to be used when the chain assembly is driven in either a clockwise or counterclockwise direction.

26. The elevator assembly of claim 22, wherein the C shape holder is structured such that a predetermined location of a pin is a certain distance away from a centerline of a flight cup, regardless of its orientation.

27. The elevator assembly of claim 22, wherein the C shape holder is structured to release pins at an upper portion of the chain assembly.

28. The elevator assembly of claim 1, wherein a speed of the chain drive assembly and positioning of the pin holders are arranged such that pins exit onto a distributor at a same interval.

29. The elevator assembly of claim 1, wherein the alternating tabs are flight tabs that are structured to prevent double feed pins on the pin holders and ensures only one pin per pin holder.

30. The elevator assembly of claim 1, further comprising guide plates to align pins with a distributor belt which rotates to various angles in relation to the elevator assembly, which is stationary.

31. The elevator assembly of claim 1, wherein the looped track assembly includes a chain track that is formed by protrusions on front and rear panels such that when assembled together, the front panel and the rear panel create the chain track.

32. The elevator assembly of claim 1, wherein the looped track assembly includes a chain track having a lower portion constructed of a constant radius which maintains a spacing of the pin holders.

33. The elevator assembly of claim 1, wherein the looped track assembly includes a chain track having an upper portion having a straight section which allows time for each pin to fall away from a flight cup and to roll down an orientor pan out of the elevator assembly.

34. The elevator assembly of claim 1, further comprising a pin exit that includes a blocking mechanism to block pins in order to recycle the pins either for cleaning or at-will depositing of the pins onto a distributor for other pinspotter operations.

35. A pin holder comprising:

a tab portion structured to support a head of a bowling pin; and a body portion having a "C" shape geometry, the body portion spaced apart from the tab portion, the body portion and the tab portion capable of being mounted on an elevator assembly, the body portion comprising:

sloped surfaces extending to a central ridge which has a diameter that is less than a circumference of a pin and other portions of the body portion and which is structured to prevent the pin from sliding completely therethrough and will hold the pin at a predetermined distance from a central portion, regardless of the orientation of the pin; and an opening structured to pick up and hold pins entering from either a first orientation which is head first or a second orientation which is bottom first.

36. The pin holder of claim 35, wherein the "C" shaped geometry is structured pick up the pin head first or body first, regardless of whether the pin holder is rotated in either a clockwise or counterclockwise direction.

37. The pin holder of claim 35, wherein the "C" shaped geometry handles the pins by a belly of the pin, head-up or head-down, eliminating uneven spacing caused by extra length when pushing the pin from an end.

38. The pin holder of claim 35, wherein the opening is defined by two ends that are spaced apart by about 120°.

39. The pin holder of claim 38, wherein a first edge forming the opening is about 30° off center and a second edge forming the opening is about 90° off center.

40. The pin holder of claim 35, is made from a thermoplastic material.

41. A sprocket drive assembly, comprising:

a sprocket;

a driving sheave;

a driven sheave driven by the driving sheave and coupled to the sprocket by a shaft;

an adjustable idler pulley; and a belt wrapped about the driving sheave and adjustable idler pulley on an inside portion of the belt and around the driven sheave by approximately 90° on an outside portion of the belt, which acts as a clutch mechanism, wherein the adjustable idler pulley is structured to adjust a tension of the belt about the driven sheave.

42. An elevator assembly, comprising:

a looped track assembly;

a chain assembly having rollers that roll on the looped track assembly, the chain assembly comprises spaced apart pin holders and alternating flight cups, each of which are extending from the chain; and a sprocket drive assembly, which engages the chain assembly, wherein the pin holders each include:

a tab portion; and a body portion having a "C" shaped geometry, the body portion extending from the tab portion, the body portion comprising:

slope surfaces extending to a central ridge which that is structured to prevent a pin that has a diameter larger than a circumference of the central ridge from sliding completely therethrough and will hold the pin at a predetermined distance from a central portion, regardless of the orientation of the pin; and an opening structured to pick up and accommodate pins entering from either a first orientation that is head first or a second orientation which that is bottom first;

wherein the sprocket drive assembly, comprises:

a sprocket;

a driving sheave;

a driven sheave driven by the driving sheave and coupled to the sprocket by a shaft;

an adjustable idler pulley; and a belt wrapped about the driving sheave and adjustable idler pulley on an inside portion of the belt and around the driven sheave by approximately 90° on an outside portion of the belt, which acts as a clutch mechanism, wherein the adjustable idler pulley is structured to adjust a tension of the belt about the driven sheave; and the sprocket has a plurality of teeth, the plurality of teeth having a tooth profile comprising:

a first radius of about 0.2, which has an arc length of 69° as measured from a horizontal centerline CL to a point "A" on a tooth;

immediately adjacent and transitioning from the first radius is a second radius of about 0.87, which has an arc length of 14.4°, as measured from the point "A" to point "B" remote from a tooth; and immediately adjacent and transitioning from the second radius is a third radius of about 0.09, which transitions into a flat portion FL of the tooth.

* * * * *